US010760591B2

(12) United States Patent
Ichigaya

(10) Patent No.: US 10,760,591 B2
(45) Date of Patent: Sep. 1, 2020

(54) AIR BLOWING DEVICE

(71) Applicant: SFT LABORATORY CO., LTD., Itabashi-ku, Tokyo (JP)

(72) Inventor: Hiroshi Ichigaya, Tokyo (JP)

(73) Assignee: SFT LABORATORY CO., LTD., Tokyo (JP)

( * ) Notice: Subject to any disclaimer, the term of this patent is extended or adjusted under 35 U.S.C. 154(b) by 495 days.

(21) Appl. No.: 15/521,193

(22) PCT Filed: Oct. 24, 2014

(86) PCT No.: PCT/JP2014/078364
§ 371 (c)(1),
(2) Date: Apr. 21, 2017

(87) PCT Pub. No.: WO2016/063416
PCT Pub. Date: Apr. 28, 2016

(65) Prior Publication Data

US 2017/0350419 A1 Dec. 7, 2017

(51) Int. Cl.
*F04D 29/64* (2006.01)
*F04D 29/60* (2006.01)
(Continued)

(52) U.S. Cl.
CPC ..... *F04D 29/644* (2013.01); *A47C 7/021* (2013.01); *A47C 7/744* (2013.01); *F04D 25/08* (2013.01);
(Continued)

(58) Field of Classification Search
CPC ..... F04D 13/00; F04D 13/02; F04D 13/06; F04D 17/08; F04D 17/16; F04D 23/001;
(Continued)

(56) References Cited

U.S. PATENT DOCUMENTS 5,610,877 A 3/1997 Adams et al.
2002/0150478 A1 10/2002 Aoki
(Continued)

FOREIGN PATENT DOCUMENTS

DE 29902125 U1 4/1999
GB 1166469 A * 10/1969 ..... F04D 25/12
(Continued)

OTHER PUBLICATIONS

International Search Report (ISR) and Written Opinion dated Jan. 27, 2015 issued in International Application No. PCT/JP2014/078364.
(Continued)

*Primary Examiner* — Patrick Hamo
*Assistant Examiner* — Chirag Jariwala
(74) *Attorney, Agent, or Firm* — Holtz, Holtz & Volek PC

(57) ABSTRACT

An air circulator which is attached to a sheet member and which is for generating an air flow from one side of the sheet member to another side of the sheet member includes a fan main body and a ring member for attaching the fan main body to the sheet member. The fan main body includes a hollow cylinder unit, a flange formed on the cylinder unit, a motor fixing unit, a motor fixated to the motor fixing unit, a wing attached to a rotating shaft of the motor and first engaging units formed on outer surfaces of first parts of the cylinder unit, the first parts forming a pair and facing each other. The ring member includes second engaging units which are formed on inner surfaces of second parts that form a pair, the second parts facing each other, and which engage with the first engaging units.

16 Claims, 15 Drawing Sheets

(51) Int. Cl.

| | |
|---|---|
| ***A47C 7/02*** | (2006.01) |
| ***F04D 25/12*** | (2006.01) |
| ***F04D 29/02*** | (2006.01) |
| ***A47C 7/74*** | (2006.01) |
| ***F04D 25/08*** | (2006.01) |
| ***F04D 29/52*** | (2006.01) |
| *A41D 13/002* | (2006.01) |

(52) U.S. Cl.
CPC ..... *F04D 25/12* (2013.01); *F04D 29/023* (2013.01); *F04D 29/522* (2013.01); *F04D 29/601* (2013.01); *F04D 29/602* (2013.01); *F04D 29/646* (2013.01); *A41D 13/0025* (2013.01); *F05D 2250/14* (2013.01); *F05D 2300/501* (2013.01)

(58) Field of Classification Search
CPC ..... F04D 23/003; F04D 25/00; F04D 25/02; F04D 25/06; F04D 25/08; F04D 25/084; F04D 25/086; F04D 25/12; F04D 29/002; F04D 29/40; F04D 29/403; F04D 29/42; F04D 29/4206; F04D 29/4226; F04D 29/60; F04D 29/601; F04D 29/602; F04D 29/603; F04D 29/62; F04D 29/624; F04D 29/626; F04D 29/023; F04D 29/522; F04D 29/644; F04D 29/646; A47C 7/744; A47C 7/021; A41D 13/0025; F05D 2300/501; F05D 2250/14
USPC ..... 417/363, 410.1, 423.1, 423.15, 423.14
See application file for complete search history.

(56) References Cited

U.S. PATENT DOCUMENTS

| | | | | |
|---|---|---|---|---|
| 2007/0003419 | A1* | 1/2007 | Wu | F04D 29/601 417/363 |
| 2007/0247009 | A1* | 10/2007 | Hoffman | F04D 25/0606 310/51 |
| 2008/0304986 | A1* | 12/2008 | Kenyon | A61M 16/0066 417/423.12 |
| 2011/0031786 | A1 | 2/2011 | Kurokawa et al. | |

FOREIGN PATENT DOCUMENTS

| | | | | |
|---|---|---|---|---|
| JP | 58065004 | A | 4/1983 | |
| JP | 2002370517 | A | 12/2002 | |
| JP | 2005016419 | A * | 1/2005 | F04D 29/646 |
| JP | 2008240214 | A | 10/2008 | |
| JP | 4399765 | B2 | 1/2010 | |
| JP | 2010242601 | A | 10/2010 | |
| JP | 2011218879 | A | 11/2011 | |
| WO | 2006009108 | A1 | 1/2006 | |
| WO | 2007061088 | A1 | 5/2007 | |
| WO | WO-2007061088 | A1 * | 5/2007 | A41D 3/0025 |

OTHER PUBLICATIONS

Extended European Search Report dated Apr. 19, 2018 issued in counterpart European Application No. 14904425.7.
International Preliminary Report on Patentability (IPRP) (and English translation thereof) dated Apr. 25, 2017 issued in counterpart International Application No. PCT/JP2014/078364.

* cited by examiner

AIR BLOWING DEVICE

TECHNICAL FIELD

The present invention relates to an air circulator which is used in an air circulation-type mat, an air conditioned outer wear and the like which evaporate the sweat coming out from a human body by circulating the air and which is attached to a sheet member that is the material of the air circulation-type mat, air conditioned outer wear and the like.

BACKGROUND ART

Recently, air circulation-type mats, air conditioned outer wears and the like which evaporate the sweat coming out from human bodies by circulating the air are put into practical use (for example, see Patent Literatures 1 and 2). For example, an air circulation-type mat such as an air conditioned sitting mat includes a spacer, a sheet member and an air circulator. The spacer is for securing a space inside the air circulation-type mat. The sheet member is for covering the spacer and for example, a piece of cloth or the like is used as the sheet member. The air circulator is for generating an air flow inside the space which is secured by the spacer. Such air circulator is attached to the sheet member. By using a spacer having a configuration where its air resistance is very small, the air can flow inside the space secured by the spacer only consuming small amount of electricity.

PRIOR ART DOCUMENTS

Patent Documents

Patent Document 1: Japanese Patent No 4399765

Patent Document 2: Japanese Republication of PCT International Publication No. WO2006/009108

SUMMARY OF THE INVENTION

Problem to be Solved by the Invention

With respect to the air circulators which are used in the air circulation-type mats, air conditioned outer wears and the like, in order to improve the air conditioning effect, the air circulators need to be firmly attached to the sheet members so that the air does not leak from the attaching parts of the air circulators when operating and so that the air circulators do not come off easily from the sheet members. On the other hand, in cases where the sheet members need to be washed and the like, users need to be able to easily take off the air circulators from the sheet members.

The conventional air circulators are configured so as to be attachable and detachable to and from the sheet members to a certain extent. However, when actually using them, the users cannot easily attach the air circulators to the sheet members and cannot easily detach the air circulators from the sheet members. Therefore, the conventional air circulators have a problem that they cannot be easily attached and detached.

The present invention was made in view of the above problem and an object is to provide an air circulator having a simple configuration which allows a user to easily attach and detach the air circulator to and from a sheet member.

Means for Solving the Problem

To solve the above problem, the present invention is an air circulator which is attached to a sheet member and which is for generating an air flow from one side of the sheet member to another side of the sheet member, including:

a fan main body; and a ring member for attaching the fan main body to the sheet member, wherein the fan main body includes:

a hollow cylinder unit;

a flange which is formed on the cylinder unit so as to protrude from an outer surface of the cylinder unit in a direction approximately orthogonal to the outer surface;

a motor fixing unit for fixating a motor;

a motor which is fixated to the motor fixing unit;

a wing which is attached to a rotating shaft of the motor; and first engaging units which are formed on outer surfaces of first parts of the cylinder unit, the first parts forming a pair and facing each other, the ring member includes:

second engaging units which are formed on inner surfaces of second parts that form a pair, the second parts facing each other, and which engage with the first engaging units; and one or a plurality of protrusions formed, with respect to each of the second parts that form a pair, on an outer surface of the ring member at a part corresponding to the second part and nearby, a width between two points on an inner surface of the ring member at the second parts that form a pair equals to a width between two points on the outer surface of the cylinder unit at the first parts that form a pair or smaller than the width between the two points on the outer surface of the cylinder unit at the first parts that form a pair, a width between two points on the inner surface of the ring member at a pair of pressing parts, the pressing parts being two parts shifted from second parts that form a pair by approximately 90 degrees, is larger than a width between two points on the outer surface of the cylinder unit at two parts shifted from first parts that form a pair by approximately 90 degrees, an inner circumference of the ring member is larger than an outer circumference of the cylinder unit, the ring member is flexible, by fitting the ring member around the outer surface of the cylinder unit utilizing the flexibility of the ring member so as to make an edge part of the sheet member around an opening formed in the sheet member be held between a back surface of the flange and one end surface of the ring member and to make the first engaging units and the second engaging units engage with each other, the fan main body is attached to the sheet member, and by squeezing the pair of pressing parts of the ring member so as to make the ring member bend, engaging of the first engaging units and the second engaging unit is released and the fan main body can be detached from the sheet member.

To solve the above problem, the present invention is an air circulator which is attached to a sheet member and which is for generating an air flow from one side of the sheet member to another side of the sheet member, including:

a fan main body; and a ring member for attaching the fan main body to the sheet member, wherein the fan main body includes:

a hollow cylinder unit;

a flange which is formed on the cylinder unit so as to protrude from an outer surface of the cylinder unit in a direction approximately orthogonal to the outer surface;

a motor fixing unit for fixating a motor;

a motor which is fixated to the motor fixing unit;

a wing which is attached to a rotating shaft of the motor; and first engaging units which are formed on outer surfaces of first parts of the cylinder unit, the first parts forming a pair and the first parts facing each other, the ring member includes:

second engaging units which are formed on inner surfaces of second parts that form a pair, the second parts facing each other, and which engage with the first engaging units, a width between two points on an inner surface of the ring member at the second parts that form a pair equals to a width between two points on the outer surface of the cylinder unit at the first parts that form a pair or smaller than the width between the two points on the outer surface of the cylinder unit at the first parts that form a pair, a width between two points on the inner surface of the ring member at a pair of pressing parts, the pressing parts being two parts shifted from second parts that form a pair by approximately 90 degrees, is larger than a width between two points on the outer surface of the cylinder unit at two parts shifted from first parts that form a pair by approximately 90 degrees, an inner circumference of the ring member is larger than an outer circumference of the cylinder unit, the ring member is flexible, parts of an outer corner at end parts of the ring member on the pressing part sides, the pressing parts forming a pair, and on a side that face the flange, are chamfered, by fitting the ring member around the outer surface of the cylinder unit utilizing the flexibility of the ring member so as to make an edge part of the sheet member around an opening formed in the sheet member be held between a back surface of the flange and one end surface of the ring member and to make the first engaging units and the second engaging units engage with each other, the fan main body is attached to the sheet member, and by squeezing the pair of pressing parts of the ring member so as to make the ring member bend, engaging of the first engaging units and the second engaging unit is released and the fan main body can be detached from the sheet member.

By having the above configuration, in the air circulator of the present invention, the fan main body is placed so that the back surface of the flange of the fan main body comes in contact with the edge part of the sheet member around the opening formed in the sheet member, the positions of the first engaging units of the fan main body and the positions of the second engaging units of the ring member are matched, the ring member is fit around the outside of the cylinder unit of the fan main body from below the fan main body by utilizing the flexibility of the ring member and the first engaging units of the fan main body and the second engaging units of the ring member are engaged with each other and in such way, the ring member can be easily attach and firmly fixated to the fan main body. When the ring member and the fan main body are fixated in such way, the edge part of the sheet member around the opening formed in the sheet member is held between the back surface of the flange of the fan main body and one end surface of the ring member and thereby, as a result, the air circulator can be firmly attached to the sheet member. Further, when detaching the air circulator from the sheet member, the ring member is held by the pair of pressing parts between a thumb and an index finger, for example, and the positions corresponding to the pressing parts that form a pair are squeezed toward each other so that the inner surfaces thereof come in contact with the outer surface of the cylinder unit of the fan main body by utilizing the flexibility of the ring member. In such way, the areas near the second parts of the ring member bulge and the engaging state of the first engaging units and the second engaging unit will be released and thus, the ring member can be easily detached from the fan main body. As described above, the air circulator of the present invention has a simple configuration and a user can easily attach and detach the air circulator to and from the sheet member.

Further, in the air circulator of the present invention, with respect to each of the second parts that form a pair, one or a plurality of protrusions are formed on the outer surface of the ring member at the second part and nearby thereof or parts of the outside corner at the end parts of the ring member on the pressing part sides, the pressing parts forming a pair, and on the side that faces the flange, is chamfered and thereby, the shape of the ring member which comes in contact with the sheet member substantially becomes close to a circle shape. Therefore, even if a force toward outside is applied to the air circulator of the present invention from inside of the sheet member for some reason, the same amount of force is equally applied to any parts of the ring member and the ring member can be prevented from falling off.

Effects of the Invention

The air circulator of the present invention has a simple configuration and a user can easily attach and detach the air circulator to and from a sheet member.

EMBODIMENTS FOR CARRYING OUT THE INVENTION

Hereinafter, embodiments of the invention according to the present application will be described with reference to the drawings. Here, in the following description, a case where the air circulator of the present invention is applied to an air circulation-type mat for chair will be described.

First Embodiment

Figure 1A:
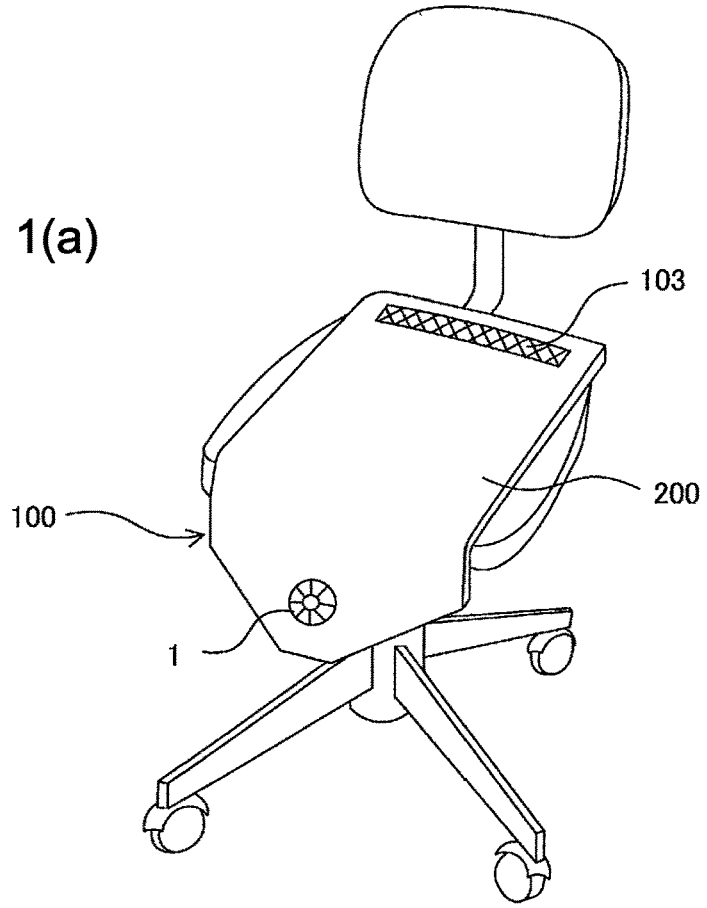
FIG. 1(*a*) is a schematic perspective view where an air circulation-type mat for chair using an air circulator which is the first embodiment of the present invention is in use and FIG. 1(*b*) is a schematic cross-sectional view where the air circulation-type mat is in use.
Figure 1B:
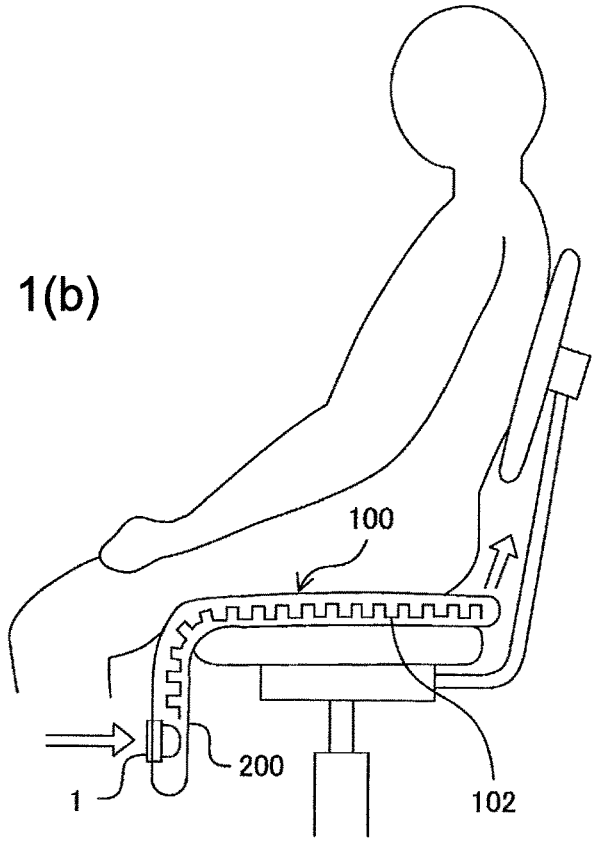

First, the first embodiment of the present invention will be described with reference to the drawings. FIG. 1(*a*) is a schematic perspective view where an air circulation-type mat for chair using an air circulator which is the first embodiment of the present invention is in use and FIG. 1(*b*) is a schematic cross-sectional view where the air circulation-type mat is in use.

The air circulation-type mat 100 for chair is used by laying it on the sitting surface of a chair. As shown in FIGS. 1(*a*) and 1(*b*), the air circulation-type mat 100 includes a bag-like sheet member 200, a spacer 102, an air outlet 103, an air circulator 1 of the present invention and a power supplying unit (not shown) such as a battery which supplies electricity to the air circulator 1.

The bag-like sheet member 200 is for covering the spacer 102. As for the sheet member 200, for example, a piece of cloth is used. The spacer 102 is for securing a space inside the sheet member 200. The space inside the sheet member 200 becomes the air flow path where the air flows through. The air circulation-type mat 100 is provided with the air outlet 103 at a predetermined end part thereof and the air which flows through the air flow path will be let out from the air outlet 103. The air circulator 1 is attached at a predetermined part of the sheet member 200 located apart from the air outlet 103. Although this will be described more in detail later, the air circulator 1 is placed at the opening which is formed in the sheet member 200 and is attached to the edge part of the sheet member 200 around the opening. The air circulator 1 is for generating an air flow from one side of the sheet member 200 to the other side.

The outside air which is taken inside the sheet member 200 by the air circulator 1 flows through the space which is secured by the spacer 102. Thereby, the sweat that came out from a user's body who is sitting on the air circulation-type mat 100 is quickly evaporated and the humidity at the bottom area can be resolved. The detail description regarding the principal and the configuration of the air circulation-type mat 100 are described in patent literatures such as the pamphlet of International Publication No. 2004/012564 and the like.

Here, by using a spacer having a configuration where its air resistance is very small such as the one described in a patent literature, for example, in Japanese Patent No 4067034, a propeller type air circulator whose air circulating pressure is low can be used as the air circulator 1 of the first embodiment. Further, although a case where the propeller of the air circulator 1 is made to rotate so as to take in the outside air through the air circulator 1 in to the sheet member 200 and to let the air out from the air outlet 103 is considered in the first embodiment, the propeller of the air circulator 1 can be made to rotate so that the outside air can be taken in through the air outlet 103 and let out from the air circulator 1.

Figure 2A:
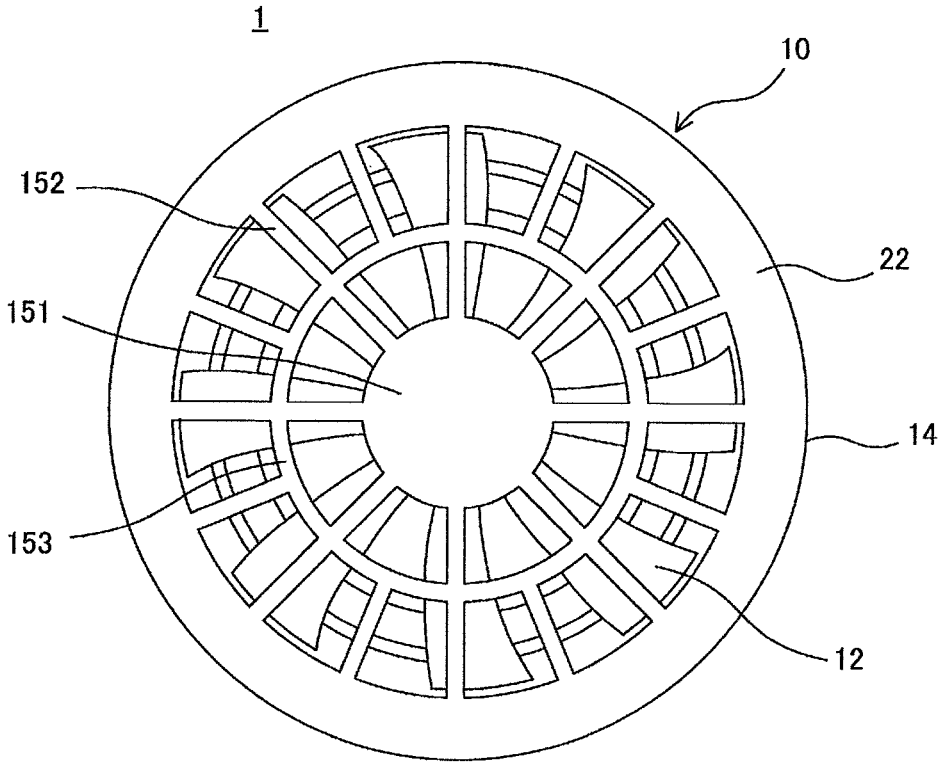
FIG. 2(*a*) is a schematic front view of the air circulator of the first embodiment and FIG. 2(*b*) is a schematic side view of the air circulator.
Figure 2B:
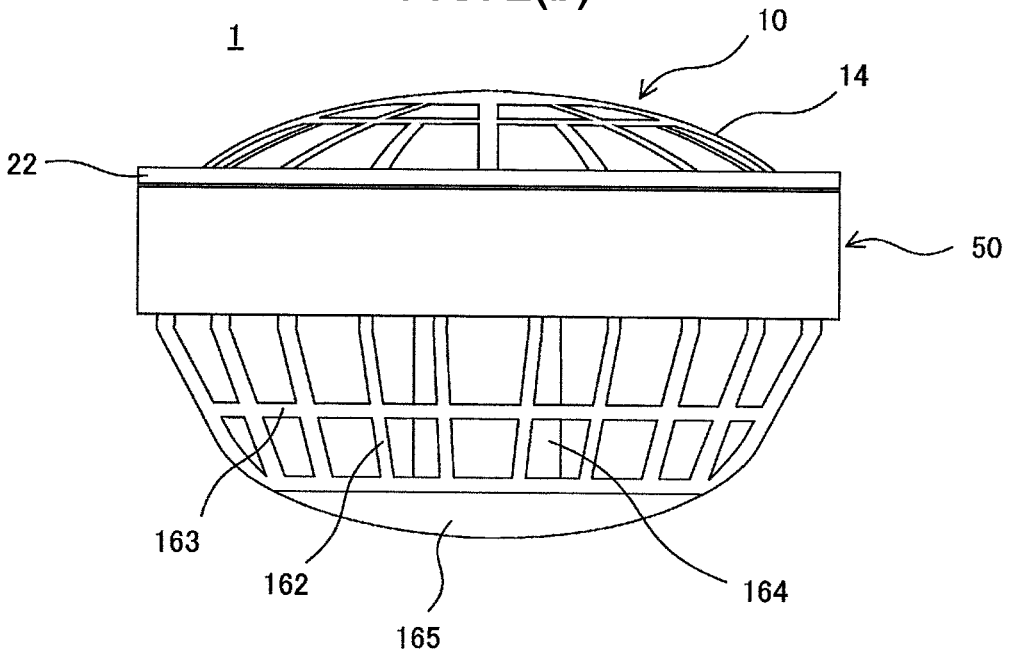
Figure 3A:
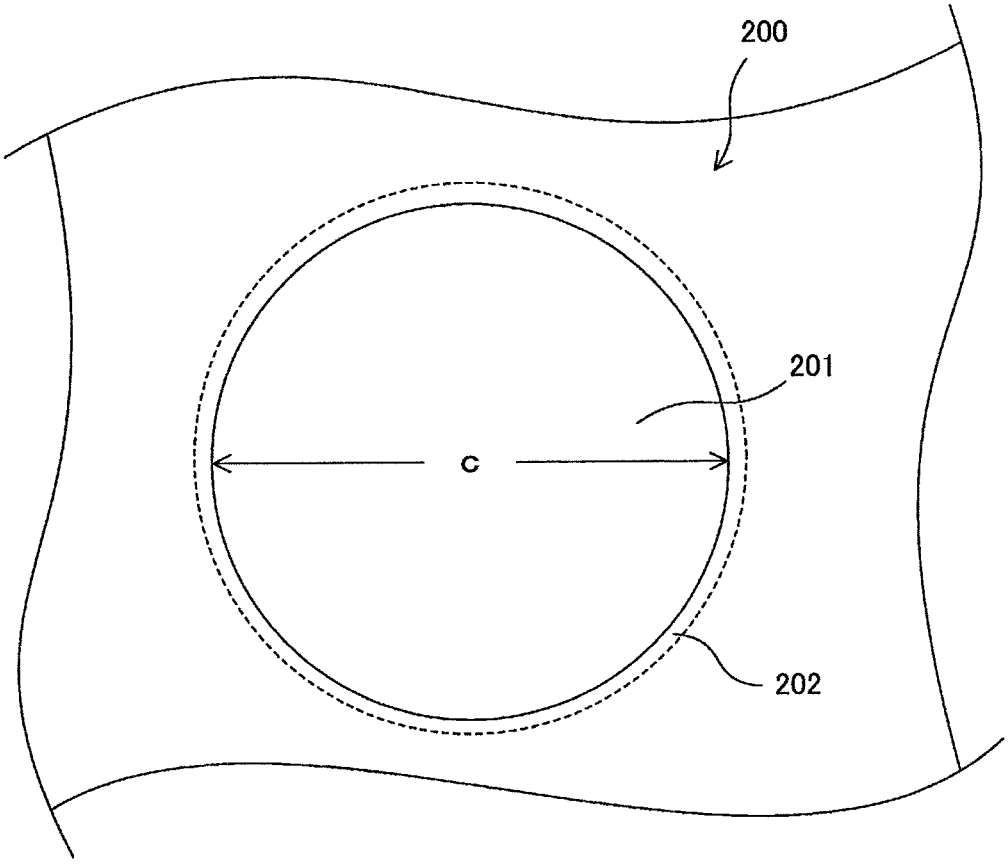
FIG. 3(*a*) is a view for describing an opening formed in a sheet member and FIG. 3(*b*) is a schematic side view for describing a state where the air circulator is attached to the sheet member.
Figure 3B:
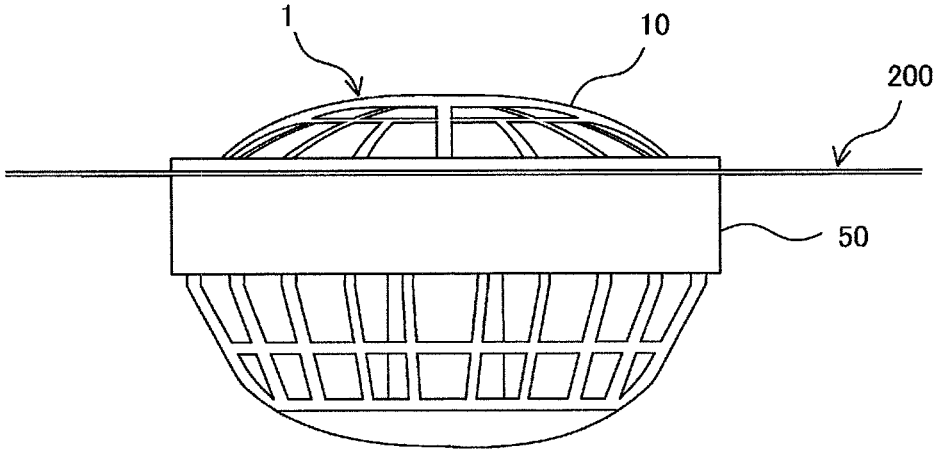
Figure 4A:
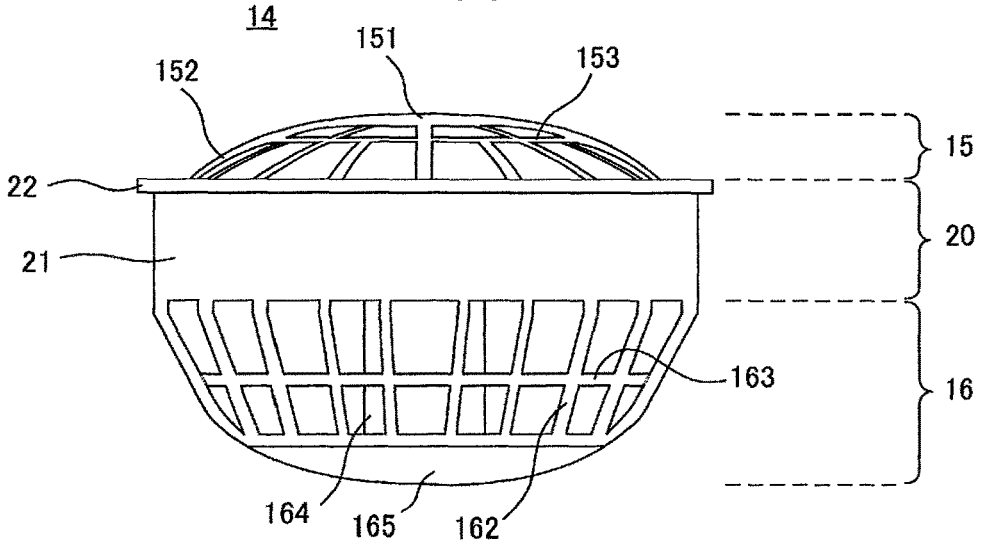
FIG. 4(*a*) is a schematic side view of a main body case of the air circulator of the first embodiment, FIG. 4(*b*) is a schematic side view of a cylinder unit with flange of the main body case, the cylinder unit with flange being the main part of the present invention, FIG. 4(*c*) is a schematic side view of the cylinder unit with flange in a state where the cylinder unit with flange shown in FIG. 4(*b*) is rotated 90 degrees around the center axis of the cylinder unit with flange and FIG. 4(*d*) is a schematic cross-sectional view of the cylinder unit with flange when cut along and seen in the directions indicated by the arrows A.
Figure 4B:
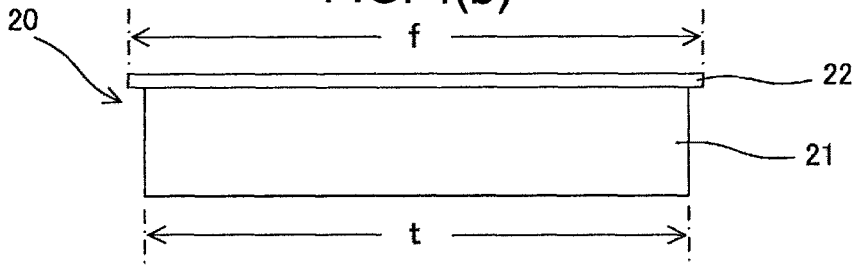
Figure 4C:
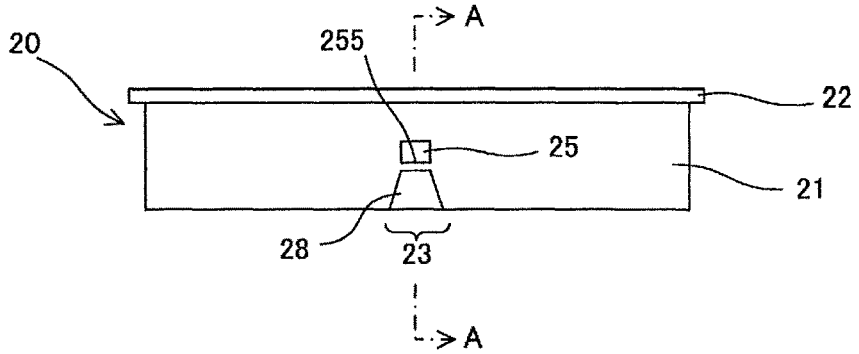
Figure 4D:
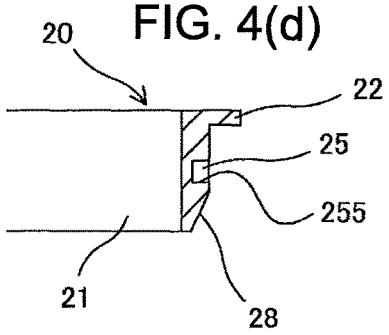
Figure 5A:
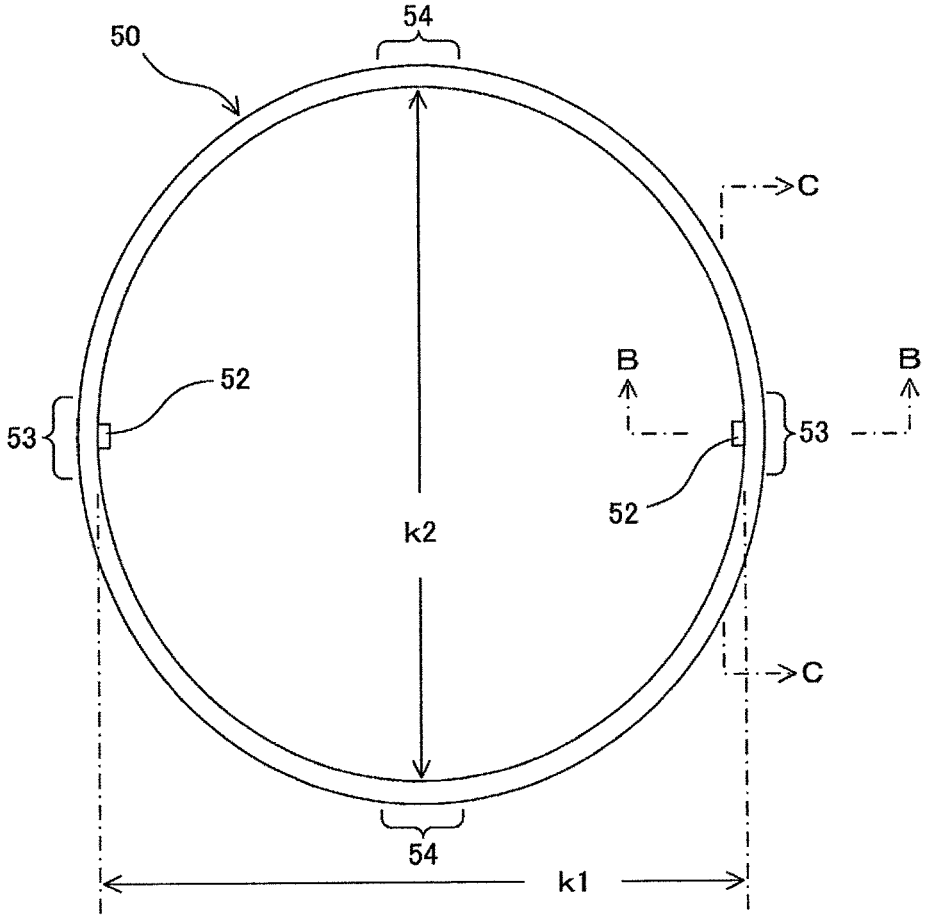
FIG. 5(*a*) is a schematic front view of an attachment ring of the air circulator of the first embodiment, FIG. 5(*b*) is a schematic side view of the attachment ring, FIG. 5(*c*) is a schematic cross-sectional view of the attachment ring when cut along and seen in the directions indicated by the arrows B and FIG. 5(*d*) is a schematic view of the attachment ring when cut along and seen in the directions indicated by the arrows C.
Figure 5B:
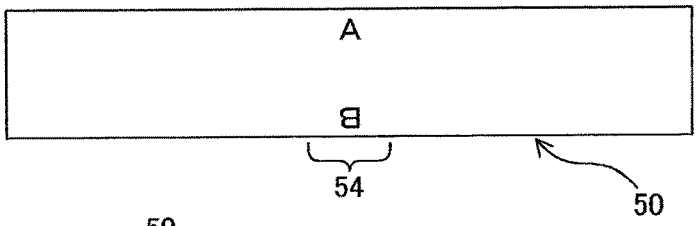
Figure 5C:
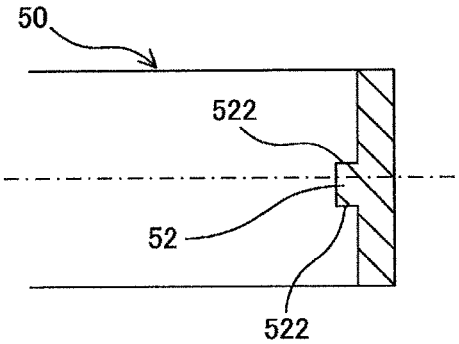
Figure 5D:
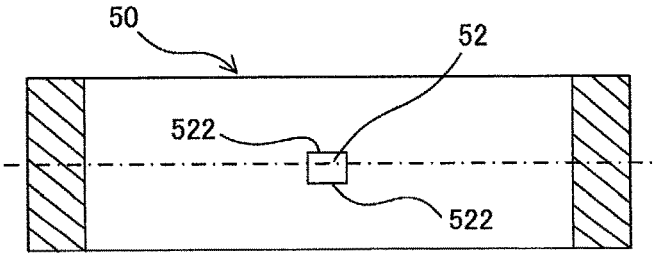
Figure 6A:
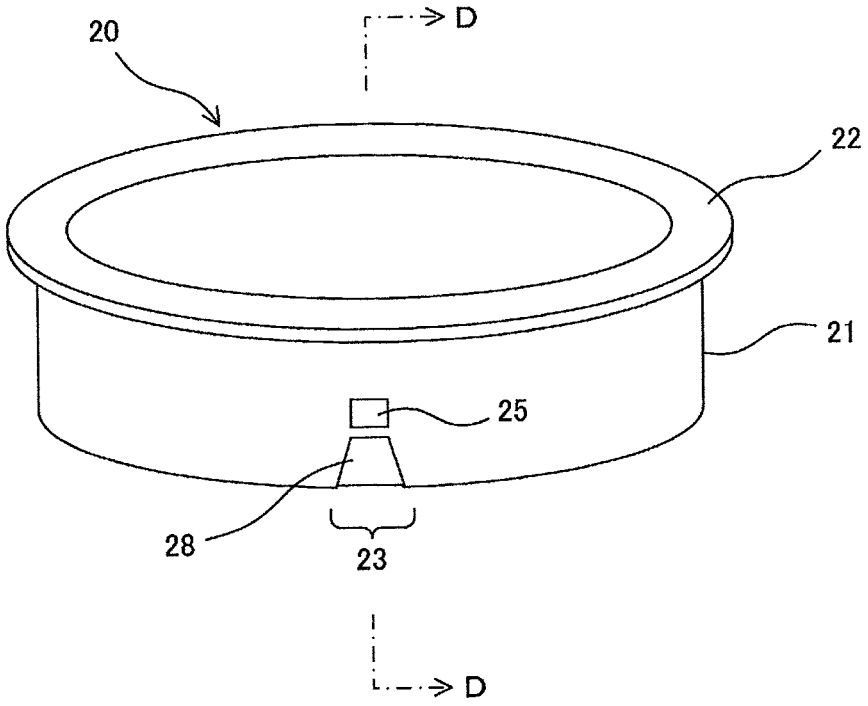
FIG. 6(*a*) is a schematic perspective view of the cylinder unit with flange of the air circulator of the first embodiment and FIG. 6(*b*) is a schematic cross-sectional view of the cylinder unit with flange when cut along and seen in the directions indicated by the arrows D.
Figure 6B:
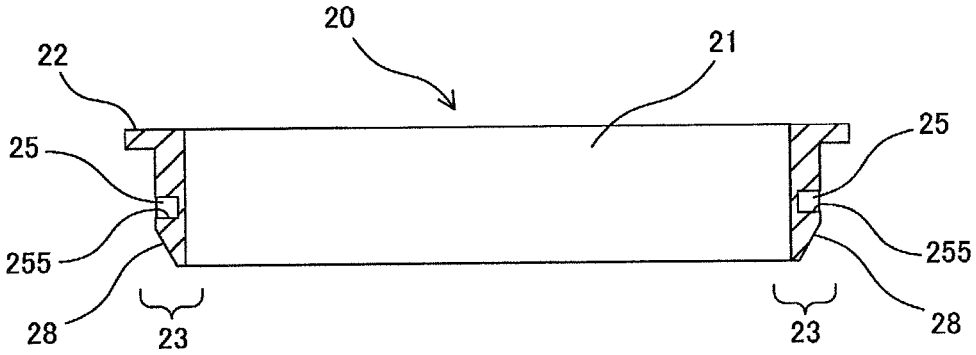

Next, the air circulator 1 of the first embodiment will be described in detail. FIG. 2(*a*) is a schematic front view of the air circulator 1 of the first embodiment and FIG. 2(*b*) is a schematic side view of the air circulator 1. FIG. 3(*a*) is a view for describing the opening formed in the sheet member 200 and FIG. 3(*b*) is a schematic side view for describing the state where the air circulator 1 is attached to the sheet member 200. FIG. 4(*a*) is a schematic side view of the main body case of the air circulator 1 of the first embodiment, FIG. 4(*b*) is a schematic side view of the cylinder unit with flange of the main body case, the cylinder unit with flange being the main part of the present invention, FIG. 4(*c*) is a schematic side view of the cylinder unit with flange in a state where the cylinder unit with flange shown in FIG. 4(*b*) is rotated for 90 degrees around the center axis of the cylinder unit with flange and FIG. 4(*d*) is a schematic cross-sectional view of the cylinder unit with flange when cut along and seen in the directions indicated by the arrows A. FIG. 5(*a*) is a schematic front view of the attachment ring of the air circulator 1 of the first embodiment, FIG. 5(*b*) is a schematic side view of the attachment ring, FIG. 5(*c*) is a schematic cross-sectional view of the attachment ring when cut along and seen in the directions indicated by the arrows B and FIG. 5(*d*) is a schematic view of the attachment ring when cut along and seen in the directions indicated by the arrows C. FIG. 6(*a*) is a schematic perspective view of the cylinder unit with flange of the air circulator 1 of the first embodiment and FIG. 6(*b*) is a schematic cross-sectional view of the cylinder unit with flange when cut along and seen in the directions indicated by the arrows D.

As shown in FIGS. 2(*a*) and 2(*b*), the air circulator 1 of the first embodiment includes a fan main body 10 and an attachment ring (a ring member) 50. The fan main body 10 is for realizing the air circulation function which is the original function of the air circulator 1. The attachment ring 50 takes a role as a tool exclusively used to attach the fan main body 10 to the sheet member 200.

The fan main body 10 includes a main body case 14, a motor (not shown) which is built in the main body case, a propeller (wing) 12 which is attached to the rotating shaft of the motor and a connector (not shown) for supplying power to the motor. Although the detail description is omitted, the main body case 14 shown in FIG. 4(*a*) includes two parts, the upper part and the lower part, and is formed by fitting these parts together. Here, since the present invention relates to a technique to attach the air circulator 1 to the sheet member 200, detailed description on the motor and the propeller 12 will be omitted and the relationship between the main body case 14 and the attachment ring 50 will be mainly described.

Next, the main body case 14 will be described. Here, upon describing the main body case 14, it is considered that the main body case 14 is divided in three parts which are the first flow unit 15, the cylinder unit with flange 20 and the second flow unit 16, in this order from the top, as shown in FIG. 4(*a*) for the sake of convenience. Among the drawings which are referred to in the present description, FIGS. 4(*b*), 4(*c*) and 4(*d*), FIGS. 6(*a*) and 6(*b*), FIGS. 7(*a*) and 7(*b*), FIGS. 11(*a*) and 11(*b*) and FIGS. 12(*a*) and 12(*b*) do not show the entire main body case 14 and only show the cylinder part with flange 20, the first flow unit 15 and the second flow unit 16 being omitted.

As shown in FIGS. 2(*a*) and 2(*b*) and FIG. 4(*a*), the first flow unit 15 includes a round shaped center base unit 151, a plurality of bar units 152 which extend radially from the center base unit 151 and a ring unit 153 whose center is the center base unit 151. Since the first flow unit 15 has such configuration, the first flow unit 15 allows sufficient air to pass through easily and the outside air can be taken inside when the propeller 12 rotates. Further, the first flow unit 15 also takes up the role as a finger guard which protects fingers from being caught in the rotating propeller 12. The lower part of the first flow unit 15 continues to the cylinder unit with flange 20.

As shown in FIGS. 2(*a*), 2(*b*) and 4(*a*)-4(*d*), the cylinder unit with flange 20 includes a flange 22 which is formed in continuation of the bar units 152 of the first flow unit 15 and a hollow cylinder unit 21. The cross-section of the cylinder unit 21 when it is cut along the plan surface orthogonal to the center axis thereof is a round shape. Concaves (the first engaging units) 25 are formed at predetermined parts of the cylinder unit 21. The lower part of the cylinder unit with flange 20 continues to the second flow unit 16.

As shown in FIG. 2(*b*) and FIG. 4(*a*), the second flow unit 16 includes a plurality of bar units 162, a ring unit 163, a motor fixing unit 164 for fixating the motor and a motor cover 165 which is attached under the motor fixing unit 164. The part formed of the plurality of bar units 162 and the ring unit 163 allows sufficient air to pass through easily and this part can protect fingers from being caught in the rotating propeller 12.

Since the main body case 14 has such configuration, when the motor fixated to the motor fixing unit 164 rotates and the propeller 12 is made to rotate by the motor, the outside air is taken in through the first flow unit 15 and is let out from the second flow unit 16.

As described above, the present invention relates to a technique to attach the air circulator 1 to the opening formed in the sheet member 200 and the cylinder unit with flange 20 and the attachment ring 50 which are a part of the main body case 14 relate to this technique. Therefore, the cylinder unit with flange 20 will be described more in detail.

In the first embodiment, the outer diameter t (the width between two points on the outer surface) of the cylinder unit 21 of the cylinder unit with flange 20 is 90 mm as shown in FIG. 4(*b*). In such case, the inner diameter c of the opening 201 formed in the sheet member 200 is 90 to 91 mm being the same size or slightly larger than the outer diameter t of the cylinder unit 21 as shown in FIG. 3(*a*). Further, as shown in FIG. 2(*a*) and FIGS. 4(*b*) and 4(*c*), the flange 22 is formed in a round ring shape and protrudes in the direction approximately orthogonal to the outer surface of the cylinder unit 21 at the upper end of the cylinder unit 21. The outer diameter f of the flange 22 is sufficiently larger comparing to the inner diameter c of the opening 201 formed in the sheet member 200 and is 97 mm, for example. Furthermore, the outer diameter of the second flow unit 16 is 90 mm at the part continuing from the cylinder unit 21 and becomes smaller as approaching the lower part thereof.

Since the relationship between the size of each part of the fan main body 10 and the size of the opening 201 formed in the sheet member 200 is as described above, the fan main body 10 can be easily inserted in to the opening 201 formed in the sheet member 200 from above. At this time, the back surface of the flange portion 22 comes in contact with the upper surface of the edge part 202 of the opening 201 (see FIG. 8(*a*)).

Further, as shown in FIGS. 4(*c*), 4(*d*) and FIGS. 6(*a*) and 6(*b*), the cylinder unit 21 is provided with concaves 25 which are the first engaging units at two predetermined parts of the cylinder unit 21 that are symmetrical with respect to the center axis, that is, at the outside of the two predetermined parts (a pair of the first engaging parts (the first parts) 23) of the cylinder unit 21 that face each other. The concaves 25 are for fixating the attachment ring 50 to the fan main body 10. The concaves 25 are formed in an approximately square shape when seen from the front and are formed at approximately center of the cylinder unit 21 in the height direction thereof. Further, each of the concaves 25 includes an engaging wall 255 at the lower surface thereof. Here, the lower surfaces themselves of the concaves 25 correspond to the engaging walls 255. Therefore, the engaging walls 255 are formed so as to be approximately orthogonal to the outer surface of the cylinder unit 21. Furthermore, the guide inclination units 28 are formed on the outer surface of the cylinder unit 21 at the first engaging parts 23 below the concaves 25. As shown in FIG. 4(*d*) and FIG. 6(*b*), each of the guide inclination units 28 is formed so that the thickness of the cylinder unit 21 be thinner as approaching the lower side thereof. Moreover, as shown in FIG. 4(*c*), the horizontal width of each of the guide inclination units 28 is about the same as the horizontal width of its corresponding concave 25 at the upper side thereof, but the horizontal width of the guide inclination unit 28 becomes wider as approaching the lower side thereof.

Next, the attachment ring 50 will be described. As shown in FIG. 5(*a*), the attachment ring 50 is formed in an oval shape when seen from above (the cross-section shape when the attachment ring 50 is cut along the plan orthogonal to the center axis thereof). The attachment ring 50 is provided with protrusions 52 which are the second engaging units on the inner surface thereof at two predetermined parts facing each other in the minor axis direction thereof (a pair of the second engaging parts (the second parts) 53). Here, the attachment ring 50 provided with two protrusions 52 is formed as one by the plastic molding. Therefore, the attachment ring 50 has the plasticity characteristic. Here, the height of the attachment ring 50 is constant around the entire circumference thereof.

As shown in FIGS. 5(*c*) and 5(*d*), the protrusions 52 are formed slightly below the center in the height direction of the attachment ring 50. Each of the two protrusions 52 is for engaging with its corresponding concave 25 of the fan main body 10 and for fixating the attachment ring 50 to the outside of the cylinder unit 21. Therefore, the positional relationship of the two protrusions 52 is the same as the positional relationship of the two concaves 25. As shown in FIGS. 5(*a*), 5(*c*) and 5(*d*), each of the protrusions 52 are formed in an approximately quadratic prism shape and protrudes toward inside of the attachment ring 50. In such way, although the shape of the protrusions 52 match the shape of the concaves 25, the size of the protrusions 52 is slightly smaller than the size of the concaves 25 so that the protrusions 52 can engage with the concaves 25. Further, each of the protrusions 52 includes an engaging wall 522 at the lower surface thereof. Here, the lower surfaces themselves of the protrusions 52 correspond to the engaging walls 522. Therefore, the engaging walls 522 are approximately orthogonal to the inner surface of the attachment ring 50. By the engaging wall 522 of each protrusion 52 and the engaging wall 255 of each concave 25 of the the cylinder unit 21 coming in contact with each other, the engaging state of the fan main body 10 and the attachment ring 50 is realized. Here, as will be described later, in a case where the attachment ring 50 is to be used in the up-side-down state, the upper surface of each protrusion 52 acts as the engaging wall 522. That is, each protrusion 52 includes the engaging walls 522 at the upper surface and lower surface thereof. Therefore, the upper surface of each protrusion 52 is approximately orthogonal to the inner surface of the attachment ring 50.

As shown in FIGS. 5(*a*) and 5(*b*), at the outside of the two parts that face each other in the long axis direction of the attachment ring 50, that is, at the outside of the two parts (a pair of pressing parts) 54 shifted from the pair of second engaging parts 53 by approximately 90 degrees, letters "A" are respectively indicated at the upper ends thereof and letters "B" are respectively indicated at the lower ends thereof. In the first embodiment, as will be described later, the attachment ring 50 can be used by setting the A side facing up or by setting the B side facing up so that the air circulator 1 can be attached to different types of sheet members 200 having various thicknesses. The letters "A" and "B" are marks indicating the direction of the attachment ring 50. Hereinafter, it is assumed that the attachment ring 50 is attached to the fan main body 10 by setting the "A" side facing up unless mentioned otherwise.

Further, the width k1 between two points on the inner surface of the attachment ring 50 at the pair of second engaging parts 53 is smaller than the outer diameter t of the cylinder unit 21 and the width k2 between two points on the inner surface of the attachment ring 50 at the pair of pressing parts 54 is larger than the outer diameter t of the cylinder unit 21. Here, since the cylinder unit 21 is formed in a cylinder shape, both the width between two points on the outer surface of the cylinder unit 21 at the pair of first engaging parts 23 and the width between two points on the outer surface of the cylinder unit at two parts shifted from the pair of first engaging parts by approximately 90 degrees equal to t. In particular, the width k1 between two points on the inner surface of the attachment ring 50 at the pair of second engaging parts 53 is 88 mm and the width k2 between two points on the inner surface of the attachment ring 50 at the pair of pressing parts 54 is 95 mm. As a result, the length of the inner circumference of the attachment ring 50 is longer than the length of the outer circumference of the cylinder unit 21. Although the length of the inner circumference of the attachment ring 50 varies according to the height or the like of the protrusions 52, it is preferred that the length of the inner circumference of the attachment ring 50 is longer than the outer circumference of the cylinder unit 21 by 1.0% to 3.5% of the length of the outer circumference of the cylinder unit 21. Actually, in the first embodiment, the length of the inner circumference of the attachment ring 50 is longer than the length of the outer circumference of the cylinder unit 21 by about 2% of the length of the outer circumference of the cylinder unit 21.

Further, the thickness of the attachment ring 50 is 2 mm and its height is slightly lower than the height of the cylinder unit 21. Since the attachment ring 50 is flexible, for example, when the two parts (the pair of pressing parts) 54 where the letters "A" and "B" are indicated are squeezed between a thumb and an index finger, the parts of the attachment ring 50 in the minor axis direction bulge outside and the attachment ring 50 can deform into an approximately circle shape when seen from above. Thereafter, when the squeezing force is released, the attachment ring 50 returns to its original oval shape.

As shown in FIG. 2(*b*), the attachment ring 50 is attached so as to cover the outer surface of the cylinder unit 21 of the fan main body 10. At this time, the upper end surface of the attachment ring 50 faces the back surface of the flange 22.

Figure 7A:
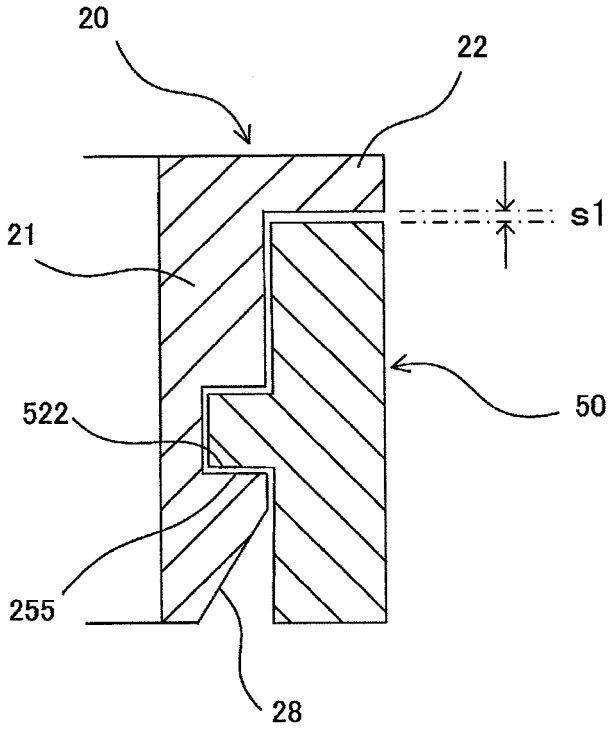
FIG. 7(*a*) is a schematic partial cross-sectional view for describing a state where the cylinder unit with flange and the attachment ring are engaged with each other and FIG. 7(*b*) is a schematic partial cross-sectional view for describing a state where the cylinder unit with flange and the attachment ring are engaged with each other where the attachment ring is being set up-side-down.
Figure 7B:
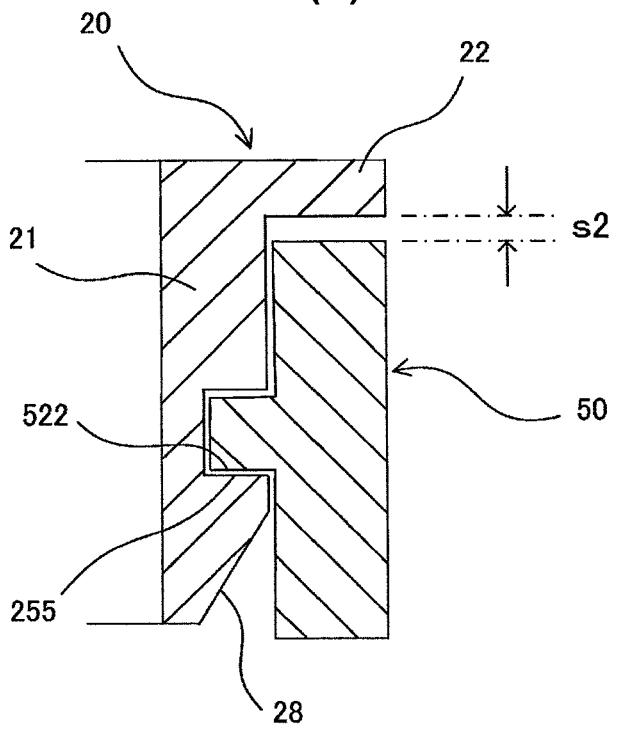
Figure 8A:
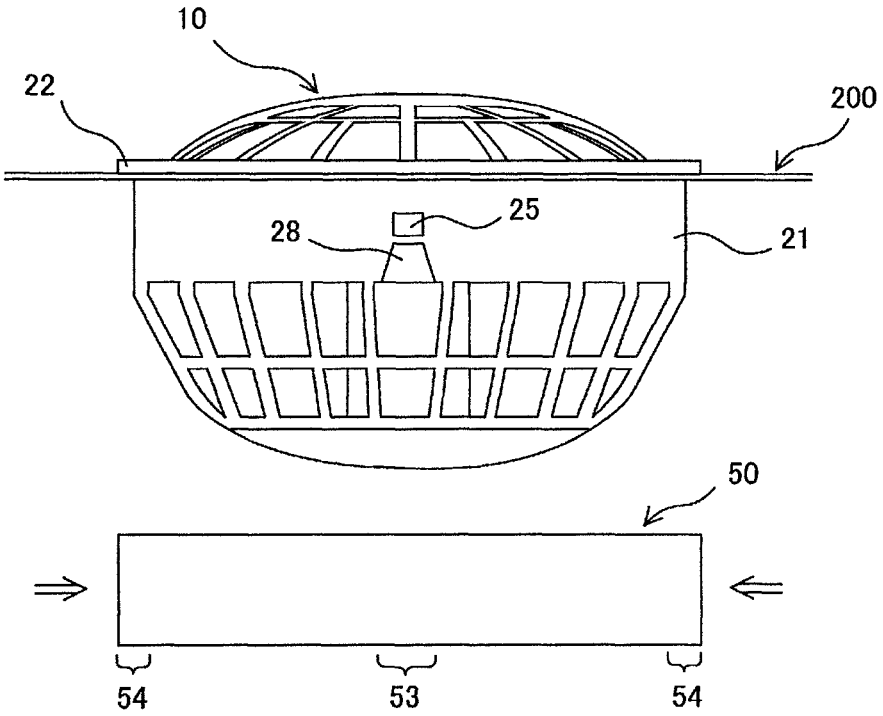
FIG. 8(*a*) is a schematic side view for describing the condition where the fan main body is inserted in the opening of the sheet member and FIG. 8(*b*) is a schematic side view for describing the condition where the air circulator is attached to the opening of the sheet member.
Figure 8B:
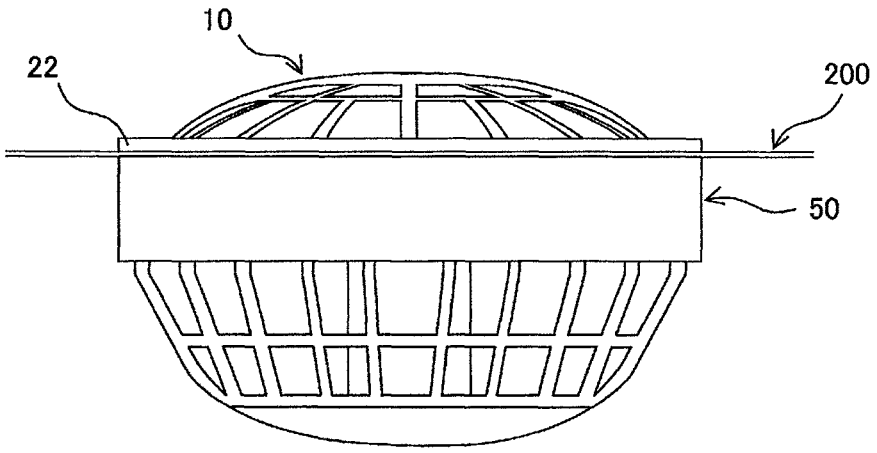

Next, the attachment procedure of the air circulator 1 to the sheet member 200 will be described. FIG. 7(*a*) is a schematic partial cross-sectional view for describing a state where the cylinder unit with flange 20 and the attachment ring 50 are engaged with each other and FIG. 7(*b*) is a schematic partial cross-sectional view for describing a state where the cylinder unit with flange 20 and the attachment ring 50 are engaged with each other where the attachment ring 50 is being set up-side-down. FIG. 8(*a*) is a schematic side view for describing the condition where the fan main body 1 is inserted in the opening of the sheet member 200 and FIG. 8(*b*) is a schematic side view for describing the condition where the air circulator 1 is attached to the opening of the sheet member 200.

As shown in FIG. 3(*a*), the opening 201 for attaching the air circulator 1 is formed in the sheet member 200. The opening 201 is formed in a circular shape and the inner diameter c of the opening 201 equals to or is slightly larger than the outer diameter t of the cylinder unit 21 which is formed in a cylinder shape. To attach the air circulator 1 to the sheet member 200, first, the fan main body 10 is inserted in the opening 201 of the sheet member 200 as shown in FIG. 8(*a*) and make the back surface of the flange 22 be in contact with the ring-shaped edge part 202 of the sheet member 200 arranged around the opening 201.

Next, the pair of pressing parts 54 of the attachment ring 50 is held between a thumb and an index finger, for example, and squeezed in the directions indicated by the arrows in FIG. 8(*a*) to deform the attachment ring 50 into an approximately circle shape. Then, while maintaining the deformed state of the attachment ring 50, the positions of the protrusions 52 of the attachment ring 50 and the positions of the guide inclination units 28 formed at the lower part of the cylinder unit 21 are matched, the attachment ring 50 is fit around the outside of the cylinder unit 21 from below the fan main body 10 and the attachment ring 50 is moved so that the two protrusions 52 are guided along the guide inclination units 28. In such way, the guide inclination units 28 guides the protrusions 52 when the attachment ring 50 is to be fit around the fan main body 10. Thereafter, when the deformed state of the attachment ring 50 is released and the attachment ring 50 is further moved upward, the protrusions 52 of the attachment ring 50 respectively enter the concaves 25 of the fan main body 10 and the protrusions 52 and the concaves 25 engage with each other. At this time, due to the flexibility of the attachment ring 50, the inner surface of the attachment ring 50 is firmly pressed against the outer surface of the cylinder unit 21 at the areas near the second engaging parts 53. Therefore, since the engaging walls 255 of the concaves 25 and their corresponding engaging walls 522 of the protrusions 52 come in contact with each other, respectively, as shown in FIG. 7(*a*), the engaging state of the protrusions 52 and the concaves 25 will not be released even if a large force is applied between the fan main body 10 and the sheet member 200. Further, since the protrusions 52 of the attachment ring 50 are respectively engaged with the concaves 25 of the fan main body 10, the attachment ring 50 will not rotate with respect to the fan main body 10.

Here, in FIG. 7(*a*), the engaging walls 255 and 522 can be formed so that the angles formed by the engaging walls 255 of the concaves 25 and the outer surface of the cylinder unit 21 and the angles formed by the engaging walls 522 of the protrusions 52 and the inner surface of the attachment ring 50 be sharp angles. In such case, the engaging state of the protrusions 52 and the concaves 25 can be made even firmer by the engaging walls 255 and the engaging walls 522 respectively biting into each other.

In such way, by the attachment ring 50 being firmly fixated to the fan main body 10 and the attachment ring 50 and the fan main body 10 being as one, as shown in FIG. 8(*b*), the ring-shaped edge part 202 of the sheet member 200 around the opening 201 is held between the back surface of the flange 22 and the upper end surface of the attachment ring 50. Therefore, the air circulator 1 can be attached to the sheet member 200 easily and unfailingly. Here, when the air circulator 1 is attached to the sheet member 200, the upper surface of the ring-shaped edge part 202 of the sheet member 200 comes in contact with the back surface of the flange 22 and the back surface of the ring-shaped edge part 202 of the sheet member 200 comes in contact with the upper end surface of the attachment ring 50. Therefore, the air does not leak from between the flange 22 and the attachment ring 50.

With respect to the air circulation-type mats, air conditioned outer wears and the like, various types of sheet members 200 having different thicknesses are used according to their usage. The air circulator 1 of the first embodiment is designed so that it can be used with various types of sheet members 200 having different thicknesses. In particular, in such design, the protrusions 52 formed on the inner surface of the attachment ring 50 are arranged at positions slightly below the center with respect to the height direction of the attachment ring 50 as shown in FIGS. 5(*c*) and 5(*d*). Therefore, the width in the height direction between the upper end surface of the attachment ring 50 and the upper side engaging walls 522 of the protrusions 52 and the width in the height direction between the lower end surface of the attachment ring 50 and the lower side engaging walls 522 of the protrusions 52 are not the same width. As shown in FIG. 5(*b*), the letters "A" and "B" are indicated at the pressing parts 54. Since the height of the attachment ring 50 is constant around the entire circumference thereof, the attachment ring 50 can be used by setting either side, the "A" side or the "B" side, facing up. FIG. 7(*a*) shows the engaging state of the cylinder unit with flange 20 and the attachment ring 50 when the attachment ring 50 is used by setting the "A" side facing up and FIG. 7(*b*) shows the engaging state of the cylinder unit with flange 20 and the attachment ring 50 when the attachment ring 50 is used by setting the "B" side facing up. If the attachment ring 50 is used by setting the "A" side facing up, the space s1 between the back surface of the flange 22 and the upper end surface of the attachment ring 50 which is formed when the protrusions 52 and the concaves 25 are engaged with each other is small as shown in FIG. 7(*a*). Therefore, such method of using the attachment ring 50 is suited to the case where the sheet member 200 is a thin material. On the other hand, if the attachment ring 50 is used by setting the "B" side facing up, the space s2 between the back surface of the flange 22 and the upper end surface of the attachment ring 50 which is formed when the protrusions 52 and the concaves 25 are engaged with each other is large as shown in FIG. 7(*b*). Therefore, such method of using the attachment ring 50 is suited to the case where the sheet member 200 is a thick material. In such way, the air circulator 1 of the first embodiment can be used with various types of sheet members 200 having different thicknesses.

Here, in the first embodiment, by forming the concaves 25, which are the first engaging units, at the center in the height direction of the cylinder unit 21 and by forming the protrusions 52, which are the second engaging units, at the positions slightly below the center in the height direction of the attachment ring 50 as described above, the air circulator 1 of the first embodiment can be used with various types of sheet members 200 having different thicknesses. In general, in order to allow the air circulator 1 of the first embodiment be used with various types of sheet members 200 having different thicknesses, the space between the back surface of the flange 22 and the upper end surface of the attachment ring 50 should be different according to which side, the upper side or the lower side, of the attachment ring 50 is set to face up when the attachment ring 50 is attached to the fan main body 10. Therefore, the positions of the first engaging units with respect to the height direction of the cylinder unit 21 and the positions of the second engaging units with respect to the height direction of the attachment ring 50 can be designed to be formed at different positions.

Figure 9A:
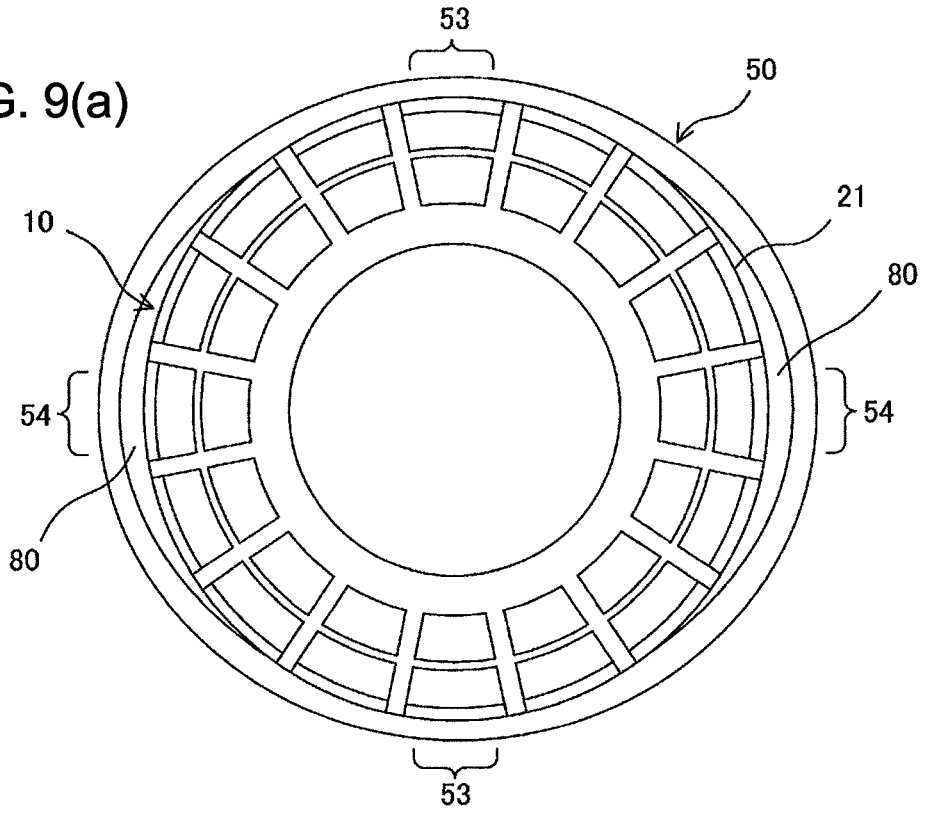
FIG. 9(*a*) is a schematic back side view of the fan main body to which the attachment ring is attached and FIG. 9(*b*) is a schematic back side view for describing a state where a pair of pressing parts of the attachment ring of the fan main body are pressed toward the center.
Figure 9B:
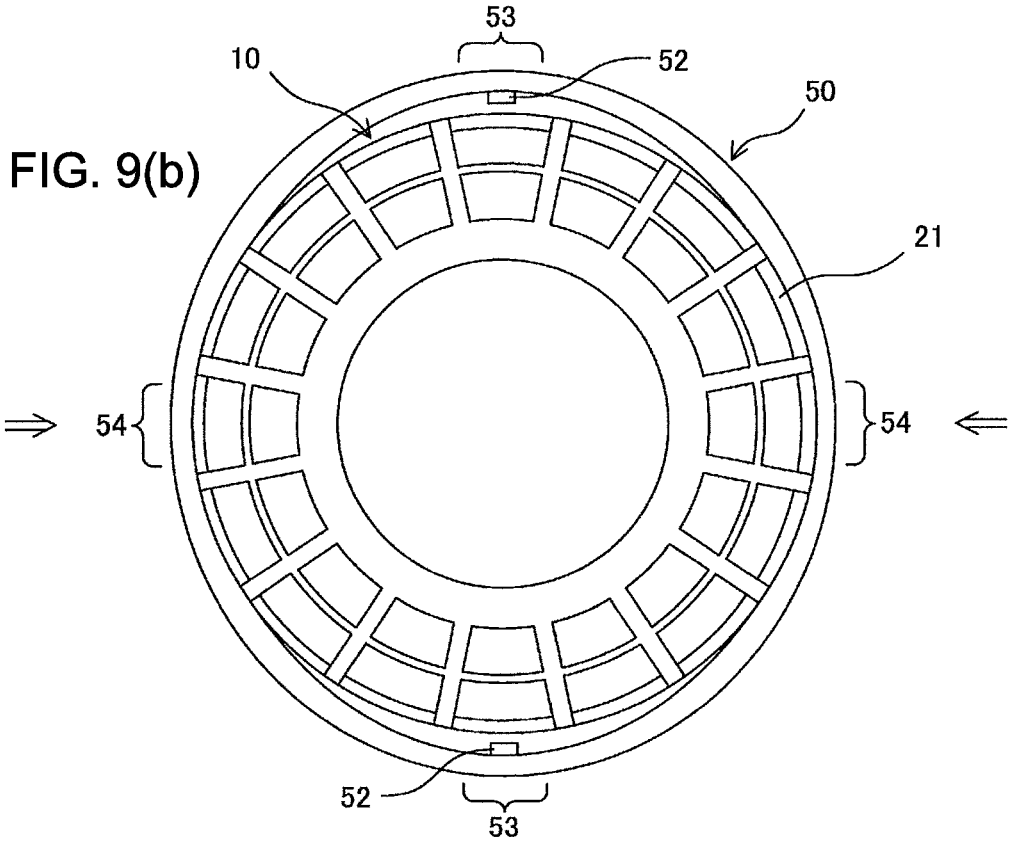

Next, the detaching procedure of the air circulator 1 from the sheet member 200 will be described. FIG. 9(*a*) is a schematic back side view of the fan main body 10 to which the attachment ring 50 is attached and FIG. 9(*b*) is a schematic back side view for describing a state where the pair of pressing parts 54 of the attachment ring 50 of the fan main body 10 are squeezed toward the center.

When seen from above (see FIG. 5(*a*)), the attachment ring 50 is formed in an oval shape where the width k1 between two points on the inner surface of the attachment ring 50 at the pair of second engaging parts 53 is smaller than the outer diameter t of the cylinder unit 21 of the fan main body 10, the width k2 between two points on the inner surface of the attachment ring 50 at the pair of pressing parts 54 is larger than the outer diameter t of the cylinder unit 21 of the fan main body 10 and the length of the inner circumference of the attachment ring 50 is longer then the length of the outer circumference of the cylinder unit 21 by about 2% of the length of the outer circumference of the cylinder unit 21. Therefore, in the state where the attachment ring 50 is attached to the fan main body 10, the inner surface of the attachment ring 50 is in contact with the outer surface of the cylinder unit 21 at the areas near the pair of second engaging parts 53 as shown in FIG. 9(*a*). On the other hand, the inner surface of the attachment ring 50 is not in contact with the outer surface of the cylinder unit 21 at the areas near the pair of pressing parts 54 and spaces 80 are formed between the inner surface of the attachment ring 50 and the outer surface of the cylinder unit 21.

To detach the air circulator 1 from the sheet member 200, first, the two pressing parts 54 are squeezed in the directions shown by the arrows in FIG. 9(*b*). In particular, the pair of pressing parts 54 of the attachment ring 50 is held between a thumb and an index finger, for example, and squeezed so that the inner surfaces of the pressing parts come in contact with the outer surface of the cylinder unit 21 of the fan main body 10. Then, due to the flexibility of the attachment ring 50, the areas near the pair of second engaging parts 53 of the attachment ring 50 bulge and the engaging state of the protrusions 52 and the concaves 25 is released. Next, while the engaging state of the protrusions 52 and the concaves 25 being released, the attachment ring 50 is pulled downward from the fan main body 10. In such way, the attachment ring 50 can be easily detached from the fan main body 10.

Further, in the case where the air circulator 1 is to be detached from the sheet member 200, the engaging state of the one side can be released first and then the engaging state of the other side can be released later instead of releasing the engaging state of both sides at the same time by squeezing the pair of pressing parts 54 of the attachment ring 50. If the attachment ring 50 is to be detached by such method, there is no need to make the inner circumference of the attachment ring 50 be larger than the outer circumference of the cylinder unit 21 by a great extent.

In the air circulator of the first embodiment, the fan main body is placed so that the back surface of the flange of the fan main body comes in contact with the ring-shaped edge part of the sheet member, the positions of the concaves of the fan main body and the positions of the protrusions of the attachment ring are matched, the attachment ring is fit around the cylinder unit of the fan main body from below the fan main body by utilizing the flexibility of the attachment ring and the concaves of the fan main body and the protrusions of the attachment ring are engaged with each other and thereby, the attachment ring can be easily attached and firmly fixated to the fan main body. When the attachment ring and the fan main body are fixated in such way, the ring-shaped edge part of the sheet member is held between the back surface of the flange of the fan main body and the upper end surface of the attachment ring and thereby, as a result, the air circulator can be firmly attached to the sheet member. Further, the pair of pressing parts is squeezed so that the inner surfaces of the pressing parts come in contact with the outer surface of the cylinder unit of the fan main body by utilizing the flexibility of the attachment ring to deform the attachment ring and thereby, the areas near the pair of second engaging parts of the attachment ring bulge and the engaging state of the concaves of the fan main body and the protrusions of the attachment ring can be easily released. Therefore, the attachment ring can be easily detached from the fan main body and the fan main body can be easily detached from the sheet member. In such way, the air circulator of the first embodiment has a simple configuration and a user can easily attach and detach the air circulator to and from the sheet member.

Further, in the air circulator of the first embodiment, the length of the inner circumference of the attachment ring is longer than the length of the outer circumference of the cylinder unit by 1.0% to 3.5% of the length of the outer circumference of the cylinder unit. Therefore, the attachment ring can be smoothly attached to and detached from the fan main body.

Furthermore, in the first embodiment, the guide inclination units for guiding the protrusions of the attachment ring when fitting the attachment ring on the fan main body are formed at the pair of first engaging parts of the cylinder unit. Therefore, the protrusions of the attachment ring can be guided to the concaves of the fan main body and the attachment ring can be smoothly attached to the fan main body.

Moreover, in the first embodiment, the height of the attachment ring is constant around the entire circumference, each of the protrusions include the engaging walls at the upper surface and the lower surface thereof, the width in the height direction between the upper end surface of the attachment ring and the upper side engaging walls of the protrusions and the width in the height direction between the lower end surface of the attachment ring and the lower side engaging walls of the protrusions are not equal to each other, and the space between the back surface of the flange and the end surface of the attachment ring that faces the back surface of the flange formed when the attachment ring is fit around the fan main body in the normal direction and the concaves and the protrusions are engaged with each other and the space between the back surface of the flange and the end surface of the attachment ring that faces the back surface of the flange formed when the attachment ring is fit around the fan main body up-side-down and the concaves and protrusions are engaged with each other are not equal to each other. Therefore, by using the attachment ring by setting either sides thereof facing up, the air circulator can be firmly fixated to the sheet member regardless of whether the sheet member is a thick material or a thin material.

Here, in the embodiment, the case where each of the protrusions of the attachment ring is provided with the engaging walls at the upper surface and the lower surface thereof so that the attachment ring can be used either way, the upper side thereof facing up or the lower side thereof facing up, is described. However, if there is no need to use the attachment ring in two ways, the upper side thereof facing up and the lower side thereof facing up, it is sufficient that each of the protrusions of the attachment ring is provided with only the lower surface engaging wall. In such case, by forming the inclination units instead of the engaging walls at the upper parts of the protrusions of the attachment ring, the attachment ring can be attached more smoothly.

Further, in the embodiment, the case where the width k1 between two points on the inner surface of the attachment ring 50 at the pair of second engaging parts 53 is smaller than the outer diameter t of the cylinder unit 21 is described. However, the width k1 between two points on the inner surface of the attachment ring 50 at the pair of second engaging parts 53 may be equal to the outer diameter t of the cylinder unit 21. This is because if the inner surface of the attachment ring 50 comes in contact with the outer surface of the cylinder unit 21 at the areas near the pair of second engaging parts 53, the attachment ring 50 and the fan main body 10 will be firmly fixated to each other.

Figure 10:
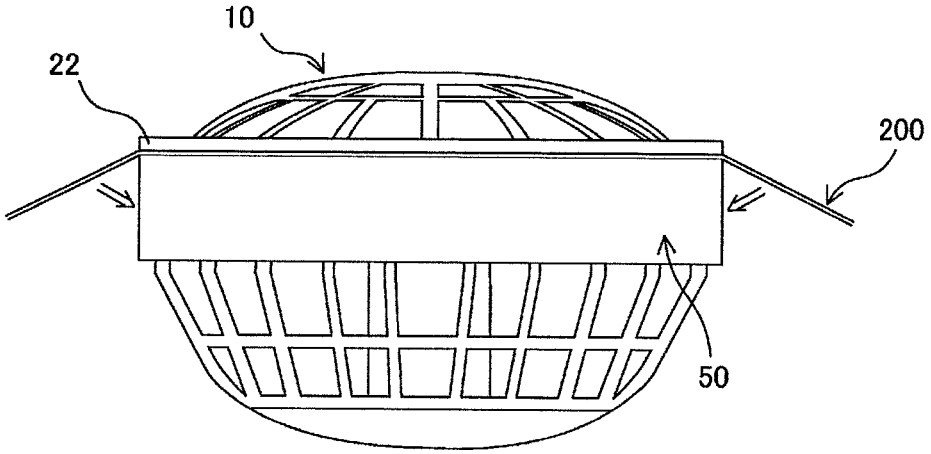
FIG. 10 is a view showing the force the attachment ring 50 receives from the sheet member 200 when it is bent.
Figure 11A:
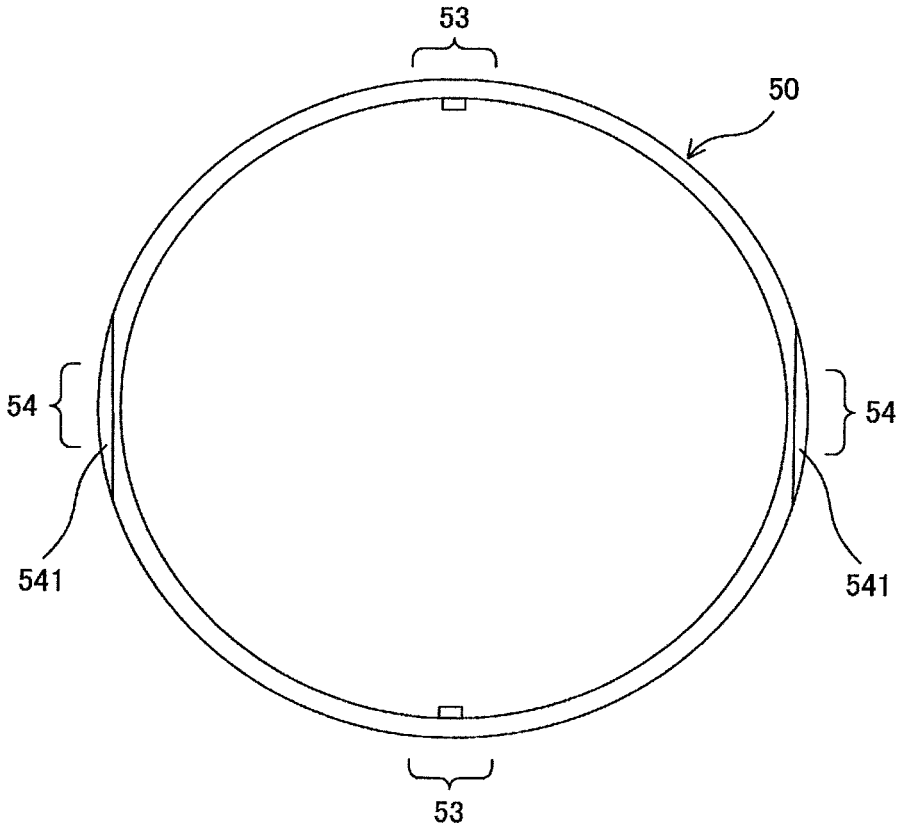
FIG. 11(*a*) is a schematic plan view of the attachment ring to which chamfering is carried out and FIG. 11(*b*) is a view for describing a state where the air circulator is attached to the sheet member by using the attachment ring to which chamfering is carried out.
Figure 11B:
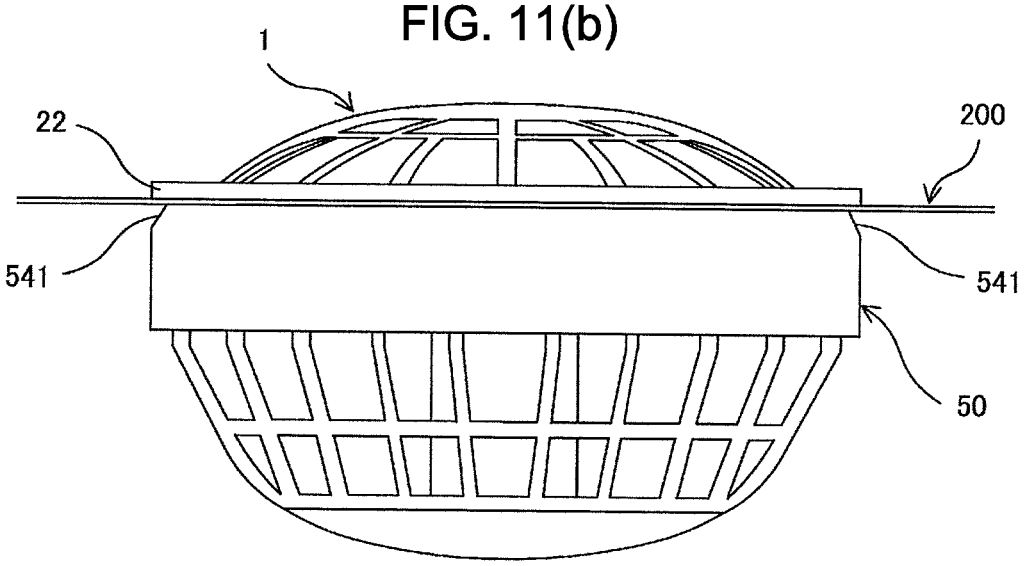

Furthermore, in the embodiment, it is preferred that the parts of the outside corner at the end parts of the attachment ring 50 on the pressing part 54 sides, the pressing parts 54 forming a pair, and on the side that faces the flange 22 is chamfered. In the state where the air circulator 1 is attached to the sheet member 200, the air circulator 1 presses against the sheet member 200 and the sheet member 200 bends at the corner of the attachment ring 50 if a force toward outside is applied to the air circulator 1 from inside of the sheet member 200 for some reason and the attachment ring 50 receives a force toward the center thereof due to the sheet member 200 bending. FIG. 10 shows the force which the attachment ring 50 receives due to the sheet member 200 bending. At this time, if the attachment ring is formed in a circle shape when seen from the above, any part of the attachment ring equally receives the same amount of force and thus, the attachment ring will not deform. In contrary, since the attachment ring 50 of the embodiment is formed in an oval shape when seen from above, the pair of pressing parts (the parts facing each other in the long axis direction) 54 of the attachment ring 50 receives a force that is greater comparing to the force which the pair of second engaging parts (the parts facing each other in the short axis direction) 53 receives. Therefore, the pair of pressing parts 54 may be pushed inside and the attachment ring 50 may deform into a circle shape causing the attachment ring 50 to fall off from the fan main body. By the parts of the outside corner at the end parts of the attachment ring 50 on the pressing part 54 sides, the pressing parts 54 forming a pair, and on the side that faces the flange 22 being chamfered, the shape of the attachment ring 50 which comes in contact with the sheet member 200 substantially becomes close to a circle shape and thus, even if a force toward outside is applied to the air circulator 1 from the inside of the sheet member 200 for some reason, the pair of pressing parts 54 acts so as to reduce the force from the sheet member 200 and the attachment ring 50 can be prevented from falling off. FIG. 11(*a*) is a schematic plan view of the attachment ring 50 to which chamfering is carried out and FIG. 11(*b*) is a view for describing a state where the air circulator 1 is attached to the sheet member 200 by using the attachment ring 50 to which chamfering is carried out. In FIGS. 11(*a*) and 11(*b*), the outer edge parts of the attachment ring 50 at the pair of pressing parts 54 and the surrounding areas thereof on the upper end side of the attachment ring 50 are the parts (chamfered parts) 541 where chamfering is carried out. Further, although the predetermined parts of the attachment ring 50 are chamfered by cutting off the parts so as to form plan surfaces in the example shown in FIGS. 11(*a*) and 11(*b*), in general, the predetermined parts of the attachment ring 50 may be chamfered by cutting off the parts so as to form curved surfaces. Here, it is preferred that the parts of the outside corner at the end parts of the attachment ring on the pressing part sides, the pressing parts forming a pair, and on the side that faces the flange be chamfered not only in the air circulator of the first embodiment but also in the air circulators of various embodiments which will be described later.

Modification Example

Next, a modification example of the first embodiment will be described.

In the above described first embodiment, the case where the first engaging units are the concaves 25 which are formed on the outer surface of the cylinder unit 21 at the pair of first engaging parts 23 and the second engaging units are the protrusions 52 which are formed on the inner surface of the attachment ring 50 at the pair of second engaging parts 53 is described. However, in this modification example, protrusions are used as the first engaging units instead of concaves and concaves are used as the second engaging units instead of protrusions. The rest of the configuration is the same as the configuration of the first embodiment described above. Therefore, the detail description will be omitted here. In the modification example, the upper surfaces of the protrusions which are the first engaging units are the engaging walls and the upper surfaces of the concaves which are the second engaging units are the engaging walls. Further, in the first embodiment, the guide inclination units are formed at the pair of first engaging parts 23. However, in the modification example, the guide inclination units are formed at the pair of second engaging parts where protrusions are not formed. As described above, the only difference is that the protrusions and the concaves are replaced with each other and thus, the air circulator of the modification example operates in the same way as the air circulator of the first embodiment. That is, the attachment procedure and the detachment procedure of the air circulator are exactly the same as the procedures described in the first embodiment. Therefore, the air circulator of the modification example has the same advantages as those of the first embodiment. Here, in the above described case, the concaves as the second engaging units may be through holes.

Second Embodiment

Figure 12A:
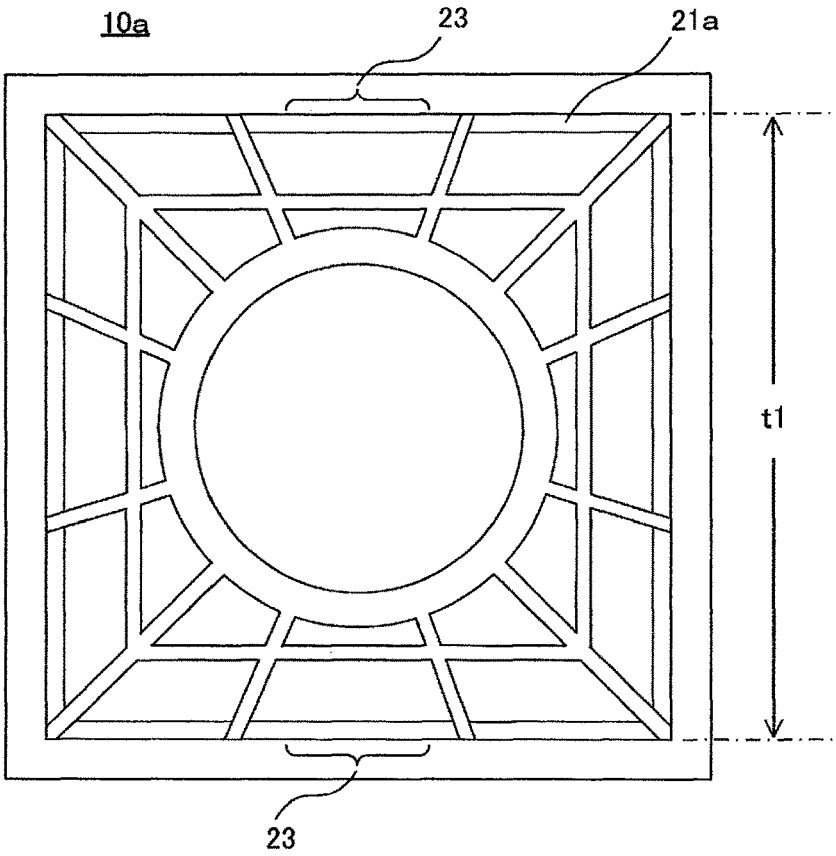
FIG. 12(*a*) is a schematic back side view of the fan main body of the air circulator of the second embodiment and FIG. 12(*b*) is a schematic front view of the attachment ring of the air circulator of the second embodiment.
Figure 12B:
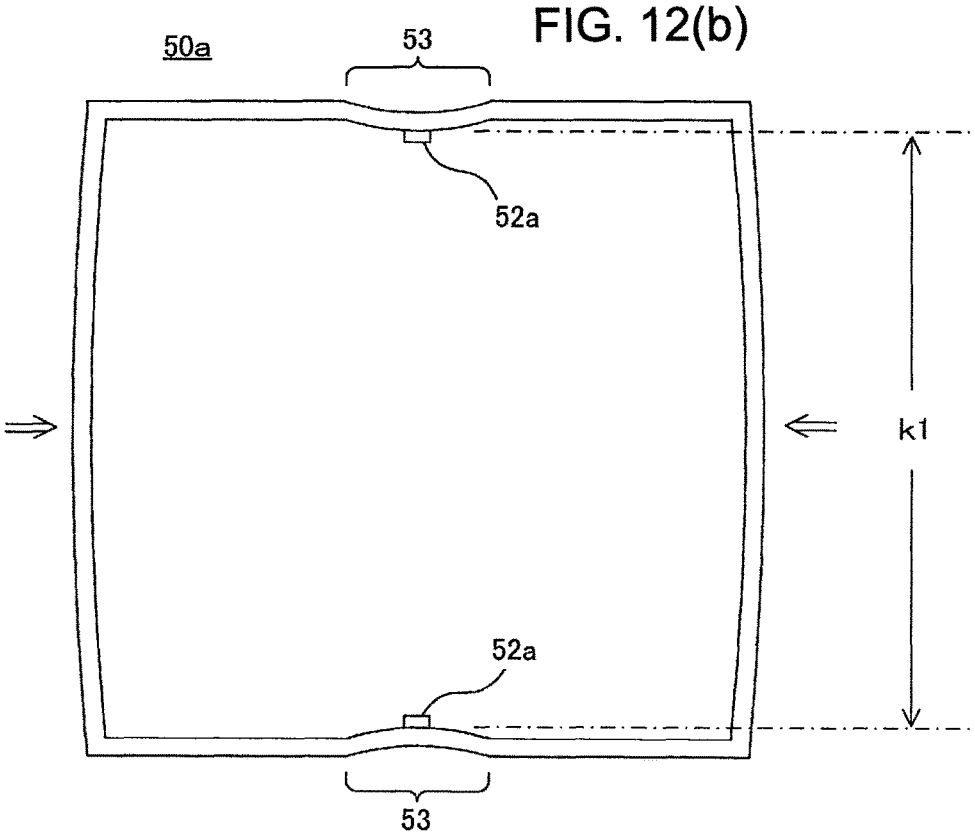
Figure 13A:
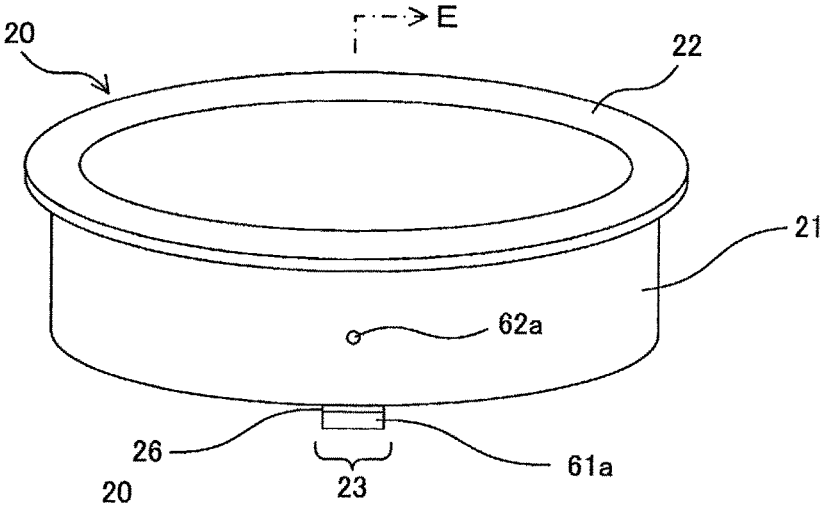
FIG. 13(*a*) is a schematic perspective view of the cylinder unit with flange of the air circulator of the third embodiment, FIG. 13(*b*) is a schematic cross-sectional view of the cylinder unit with flange when cut along and seen in the directions indicated by the arrows E, FIG. 13(*c*) is a schematic front view of the attachment ring of the air circulator of the third embodiment and FIG. 13(*d*) is a schematic cross-sectional view of the attachment ring when cut along and seen in the directions indicated by the arrows F.
Figure 13B:
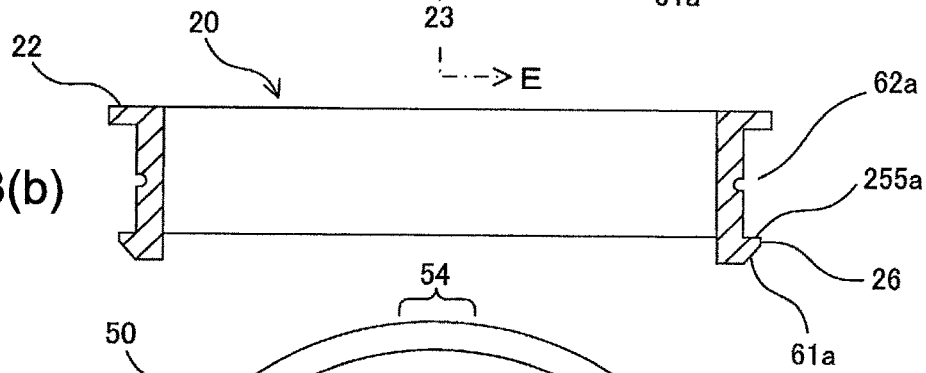
Figure 13C:
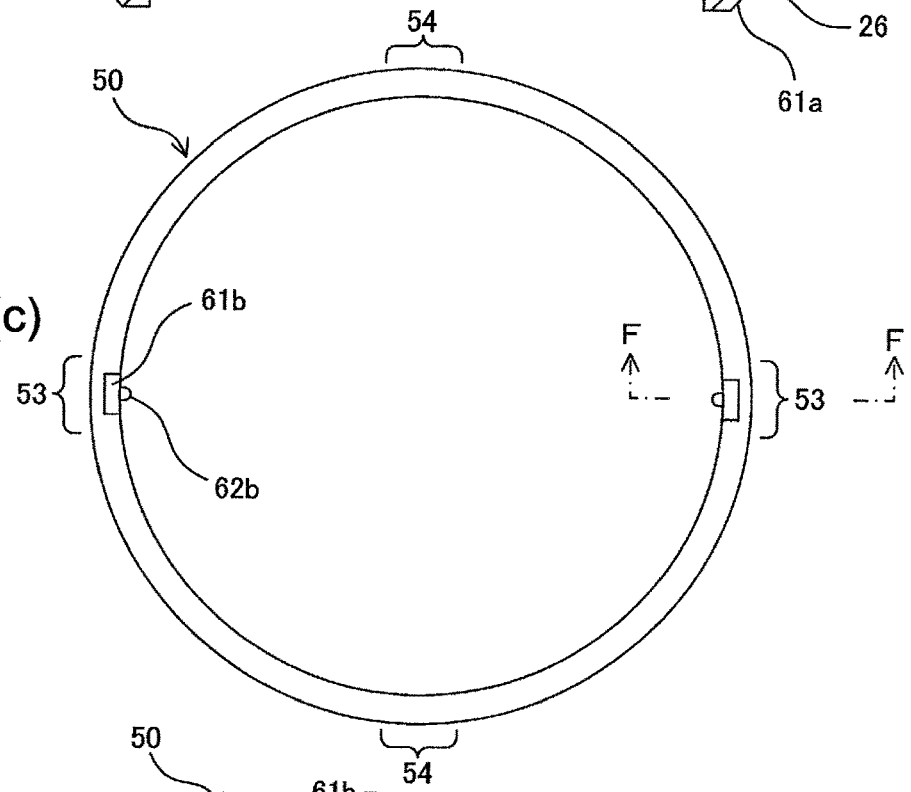
Figure 13D:
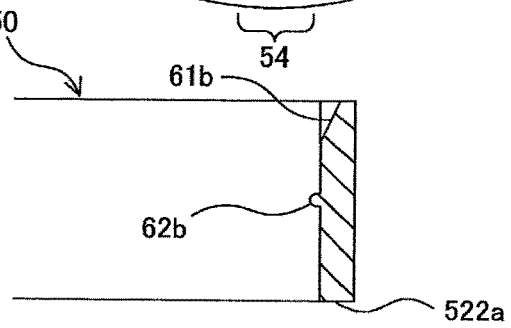
Figure 14A:
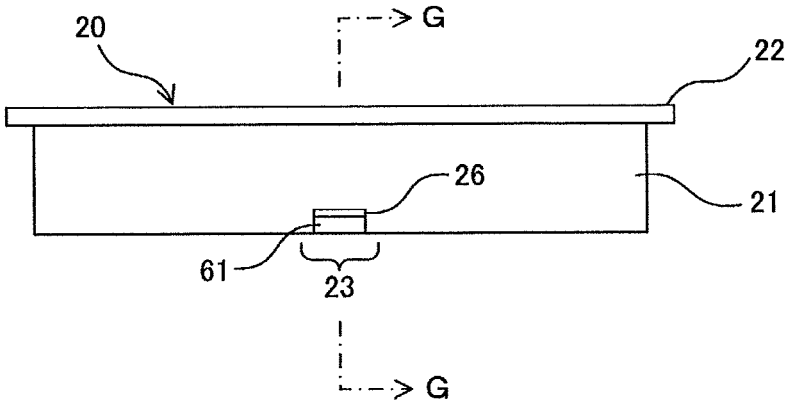
FIG. 14(*a*) is a schematic side view of the cylinder unit with flange of the air circulator of the fourth embodiment, FIG. 14(*b*) is a schematic cross-sectional view of the cylinder unit with flange when cut along and seen in the directions indicated by the arrows G, FIG. 14(*c*) is a schematic perspective view of the attachment ring of the air circulator of the fourth embodiment and FIG. 14(*d*) is a schematic cross-sectional view of the attachment ring when cut along and seen in the directions indicated by the arrows H.
Figure 14B:
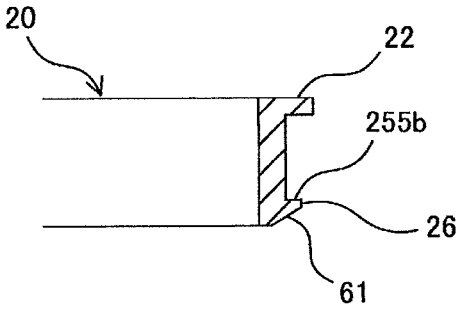
Figure 14C:
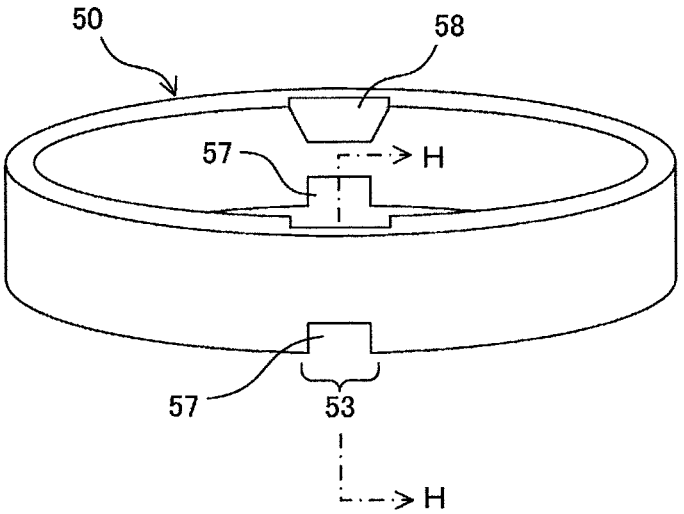
Figure 14D:
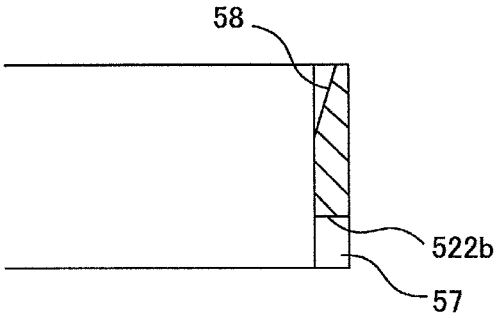

Next, the second embodiment of the present invention will be described. FIG. 12(*a*) is a schematic back side view of the fan main body of the air circulator of the second embodiment and FIG. 12(*b*) is a schematic front view of the attachment ring of the air circulator of the second embodiment.

In the above first embodiment, the case where the cross-section of the cylinder unit of the fan main body when cut along the plan surface orthogonal to the center axis thereof is a circle shape is described. However, in the second embodiment, as shown in FIG. 12(*a*), the cross-section of the cylinder unit 21*a* of the fan main body 10*a* when cut along the plan surface orthogonal to the center axis thereof is an approximately rectangular shape, for example. Concaves as the first engaging units are formed on the outer surface of the cylinder unit 21*a* at the pair of first engaging parts 23, the first engaging parts 23 facing each other. In such case, as shown in FIG. 12(*b*), the attachment ring 50*a* is also formed so that the cross-section of the attachment ring 50*a* when cut along a plan surface orthogonal to the center axis thereof be an approximately rectangular shape corresponding to the shape of the cylinder unit 21*a* of the fan main body 10*a*. The protrusions 52*a* as the second engaging units which engage with the first engaging units are formed on the inner surface of the attachment ring 50*a* at the pair of second engaging parts 53, the second engaging parts 53 facing each other. However, in the second embodiment, the areas near the protrusions 52*a* of the attachment ring 50*a* are curved inside and the width k1 between two point on the inner surface of the attachment ring 50*a* at the pair of second engaging parts 53 is slightly smaller comparing to the width t1 between two points on the outer surface of the cylinder unit 21*a* at the pair of first engaging parts 23. Further, the two sides of the attachment ring 50*a* which face each other and which do not include the second engaging parts 53 are formed so as to slightly bulge toward outside. Therefore, similarly to the first embodiment, the areas near the pair of second engaging parts 53 will bulge outside when the two sides of the attachment ring 50*a* (a pair of pressing parts) that bulge toward outside are squeezed in the second embodiment. Therefore, the air circulator of the second embodiment has the function and advantages similar to those in the case of the above described first embodiment and a user can easily attach and detach the air circulator to and from the sheet member. Here, the rest of the configuration of the second embodiment is the same as that of the above described first embodiment. Therefore, the detail description thereof is omitted here.

Third Embodiment

Next, the third embodiment of the present invention will be described. FIG. 13(*a*) is a schematic perspective view of the cylinder unit with flange of the air circulator of the third embodiment, FIG. 13(*b*) is a schematic cross-sectional view of the cylinder unit with flange when cut along and seen in the directions indicated by the arrows E, FIG. 13(*c*) is a schematic front view of the attachment ring of the air circulator of the third embodiment and FIG. 13(*d*) is a schematic cross-sectional view of the attachment ring when cut along and seen in the directions indicated by the arrows F.

In the third embodiment, as shown in FIGS. 13(*a*) and 13(*b*), the cylinder unit 21 extends downward at the pair of first engaging parts 23. Further, the protrusions 26 as the first engaging units are formed on the outer surfaces of the extended parts. Here, the upper surfaces of the protrusions 26 are the engaging walls 255*a*. Furthermore, the inclination unit 61*a* for smoothly fitting the attachment ring is formed at the lower parts of the protrusions 26. On the other hand, as shown in FIGS. 13(*c*) and 13(*d*), the second engaging units are not formed at the pair of second engaging parts 53 of the attachment ring 50 and the inclination units 61*b* for smoothly fitting the attachment ring 50 are formed at the upper end part of the attachment ring 50 at the pair of second engaging parts 53. In the third embodiment, similarly to the first embodiment, the pair of pressing parts 54 are squeezed, the positions of the inclination units 61*a* formed on the cylinder unit 21 and the positions of the inclination units 61*b* formed on the attachment ring 50 are matched and the attachment ring 50 is fit around the cylinder unit 21 from below the fan main body and thereby, the attachment ring 50 is attached to the fan main body. At this time, the engaging walls 255*a* of the cylinder unit 21 and the lower end surface of the attachment ring 50 engage with each other. That is, in such case, the parts of the lower end surface of the attachment ring 50 at the pair of second engaging parts 53 act as the engaging walls 522*a* and they can be assumed as being the second engaging units. In such way, by the engaging walls 255*a* of the cylinder unit 21 and the lower end surface 522*a* of the attachment ring 50 engaging with each other, the attachment ring 50 will not falloff from the fan main body even if an outer force is applied to the air circulator. Further, in the third embodiment, small concaves (rotation stoppers) 62*a* are formed on the outer surface of the cylinder unit 21 at the pair of first engaging parts 23 and small protrusions (rotation stoppers) 62*b* are formed on the attachment ring 50 at the parts corresponding to the concaves 62*a* so that the two sets of the rotation stoppers 62*a* and 62*b* engage with each other when the attachment ring 50 is attached to the fan main body. In such way, the attachment ring 50 can be prevented from rotating with respect to the cylinder unit 21. Since the air circulator of the third embodiment has such configuration, it has the function and the advantages similar to those of the first embodiment and a user can easily and unfailingly attach the air circulator to the sheet member and easily detach the air circulator from the sheet member. Here, the rest of the configuration of the third embodiment is the same as that of the above described first embodiment. Therefore, the detailed description thereof is omitted here.

Fourth Embodiment

Next, the fourth embodiment of the present invention will be described. FIG. 14(*a*) is a schematic side view of the cylinder unit with flange of the air circulator of the four embodiment, FIG. 14(*b*) is a schematic cross-sectional view of the cylinder unit with flange when cut along and seen in the directions indicated by the arrows G, FIG. 14(*c*) is a schematic perspective view of the attachment ring of the air circulator of the fourth embodiment and FIG. 14(*d*) is a schematic cross-sectional view of the attachment ring when cut along and seen in the directions indicated by the arrows H.

In the above third embodiment, the cylinder unit is extended downward at the pair of first engaging parts and the protrusions as the engaging units are formed on the outer surfaces of the extended parts. However, in the fourth embodiment, as shown in FIGS. 14(*a*) and 14(*b*), the cylinder unit 21 is not extended downward at the pair of first engaging parts 23 and the protrusions 26 as the first engaging units are formed on the outer surface of the cylinder unit 21 at the lower end part thereof. Here, the upper surfaces of the protrusions 26 are the engaging walls 255*b*. Therefore, the engaging walls 255*b* are positioned slightly above the lower end surface of the cylinder unit 21. On the other hand, as shown in FIGS. 14(*c*) and 14(*d*), the cutouts 57 are formed at the lower end part of the attachment ring 50 at the pair of second engaging parts 53 so as to correspond to the protrusions 26 formed on the cylinder unit 21. Here, the cutouts 57 are the second engaging units and the upper surfaces of the cutout portions of the attachment ring 50 are the engaging walls 522*b*. Further, the guide inclination units 58 for guiding the protrusions 26 are formed on the inner surface of the attachment ring 50 at the upper end part at the pair of second engaging parts 53. Since the air circulator of the fourth embodiment has such configuration, it has the function and the advantages similar to those of the third embodiment and a user can easily and unfailingly attach the air circulator to the sheet member and easily detach the air circulator from the sheet member. Here, the rest of the configuration of the fourth embodiment is the same as that of the above described third embodiment. Therefore, the detailed description thereof is omitted here.

Fifth Embodiment

Figure 15A:
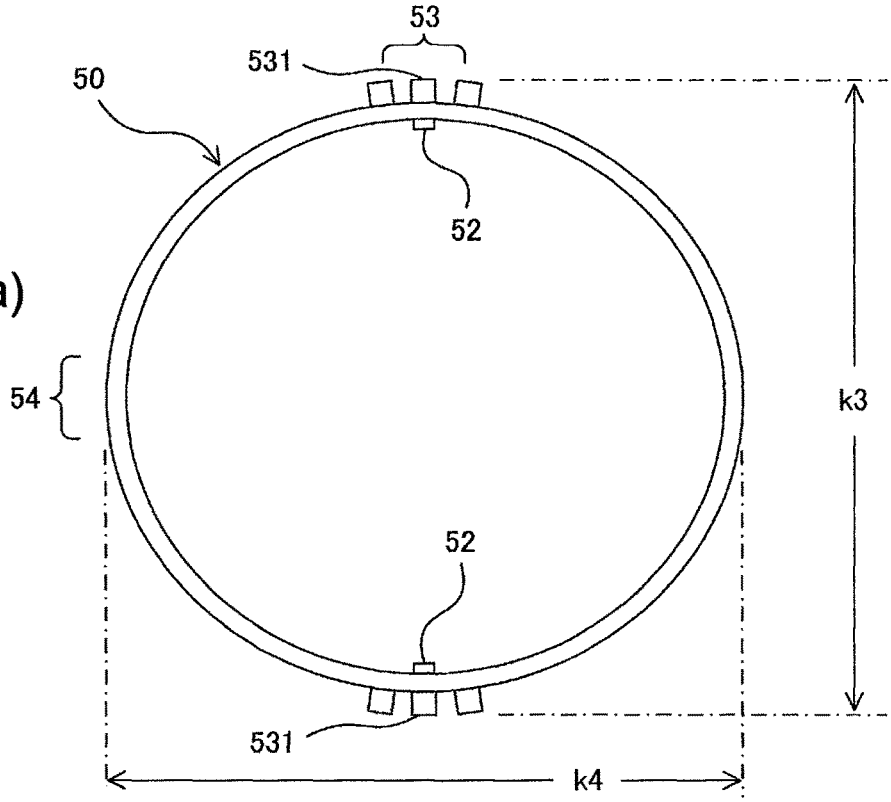
FIG. 15(*a*) is a schematic plan view of the attachment ring of the air circulator of the fifth embodiment, FIG. 15(*b*) is a schematic side view of the attachment ring and FIG. 15(*c*) is a schematic back side view of the air circulator of the fifth embodiment.
Figure 15B:
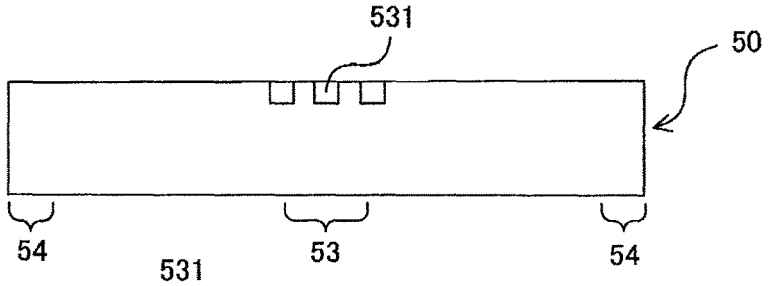
Figure 15C:
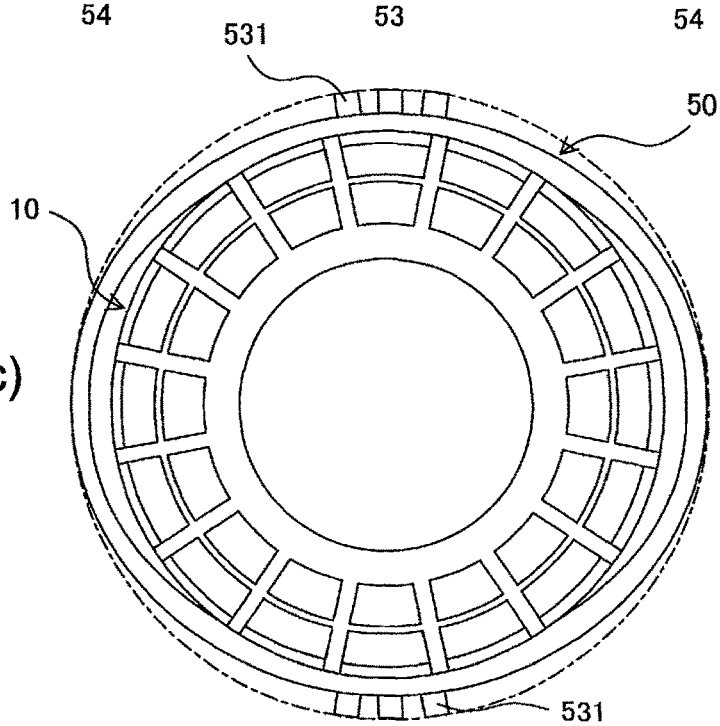

Next, the fifth embodiment of the present invention will be described. FIG. 15(*a*) is a schematic plan view of the attachment ring of the air circulator of the fifth embodiment, FIG. 15(*b*) is a schematic side view of the attachment ring and FIG. 15(*c*) is a schematic back side view of the air circulator of the fifth embodiment.

As described in the above first embodiment, as a method for preventing the attachment ring from falling off from the fan main body due to the force caused by the bending of the sheet member, the parts of the outside corner at the end parts of the attachment ring on the pressing part sides, the pressing parts forming a pair, and on the side that face the flange are chamfered. However, the method for preventing the attachment ring from falling off from the fan main body due to the force caused by the bending of the sheet member is not limited to the above described method of chamfering and for example, with respect each of the second engaging parts that form a pair, a plurality of protrusions can be formed at the part on the outer surface of the attachment ring corresponding to the second engaging part and the area nearby. The air circulator of the fifth embodiment is made by applying the method of forming, with respect to each of the second engaging parts that form a pair, a plurality of protrusions at the part on the outer surface of the attachment ring corresponding to the second engaging part and the area nearby.

In the air circulator of the fifth embodiment, as shown in FIGS. 15(*a*)-15(*c*), with respect to the second engaging parts 53 that form a pair, three protrusions 531 are formed at the part on the outer surface of the attachment ring 50 corresponding to the second engaging part 53 and the area nearby. Further, the width k3 between two points on the outer surfaces of the two protrusions 531 which are symmetrical with respect to the center of the attachment ring 50 approximately equals to the width k4 between two points on the outer surface of the attachment ring 50 at the pair of pressing parts 54. In such way, as indicated by the dashed-dotted line in FIG. 15(*c*), the shape of the attachment ring 50 which come in contact with the sheet member substantially becomes close to a circle shape. Therefore, any part of the attachment ring equally receives the same amount of force even if a force toward outside is applied to the air circulator from inside of the sheet member for some reason and thus, the attachment ring 50 can be prevented from falling off.

Here, in order to make the shape of the attachment ring 50 which come in contact with the sheet member substantially be close to a circle shape, with respect to each of the second engaging parts 53 that form a pair, one protrusion may be formed on the outer surface of the attachment ring 50 at the position corresponding to the second engaging part 53 and nearby. However, if a wide protrusion is formed, the thickness of the attachment ring 50 be thick in the areas corresponding to the second engaging parts 53 and the attachment ring 50 cannot deform easily even when the attachment ring 50 is held by the pair of pressing parts 54 and squeezed. Therefore, it is preferred that a plurality of protrusions having small width, for example, three small protrusions be formed at each of the second engaging parts that form a pair as shown in FIGS. 15(*a*)-15(*c*) (total of 6 protrusions), so that the attachment ring 50 can easily deform.

The rest of the configuration of the fifth embodiment is the same as that of the above described first embodiment. Therefore, the detailed description thereof is omitted here. The air circulator of the fifth embodiment has the function and the advantages similar to those of the first embodiment. In particular, with respect to each of the second engaging parts that form a pair, three protrusions are formed on the outer surface of the attachment ring at the part corresponding to the second engaging part and nearby to make the shape of the attachment ring which come in contact with the sheet member substantially become close to a circle shape. Therefore, any part of the attachment ring equally receives the same amount of force even if a force toward outside is applied to the air circulator from inside of the sheet member for some reason and thus, the attachment ring 50 can be prevented from falling off. Here, the method of forming, with respect to each of the engaging parts that form a pair, one or a plurality of protrusions on the outer surface of the attachment ring at the part corresponding to the second engaging part and nearby applied in the air circulator of the fifth embodiment can be applied to the air circulators of various embodiments.

Other Embodiment

The present invention is not limited to the above described embodiments and various modification can be carried out within the scope of the invention.

In each of the above embodiments, the case where the flange is protruded from the upper end of the cylinder unit in the direction approximately orthogonal to the outer surface of the cylinder unit is described. However, in general, the flange can be formed on the cylinder unit so as to protrude from the outer surface of the cylinder unit in the direction approximately orthogonal to the outer surface of the cylinder unit. For example, the flange can be formed at approximately center of the cylinder unit instead of forming it at the upper end of the cylinder unit.

In each of the above embodiments, the case where one concave or one protrusion is formed at each of the first engaging parts and one protrusion or one concave is formed at each of the second engaging parts is described. However, a plurality of concaves or a plurality of protrusions can be formed at each of the first engaging parts and a plurality of protrusions or a plurality of concaves can be formed at each of the second engaging parts, for example. In such case, the plurality of concaves or the plurality of protrusions formed at each of the engaging parts correspond to the first engaging units or the second engaging units of the present invention.

Further, in each of the above embodiments, the case where the air circulator of the present invention is applied to an air circulation-type mat for chair is described. However, the air circulator of the present invention can be applied to various types of devices which make the air circulate inside thereof such as air conditioned outer wears, for example, and not limited to the air circulation-type mat.

INDUSTRIAL APPLICABILITY

As described above, in the air circulator of the present invention, the fan main body is placed so that the back surface of the flange of the fan main body come in contact with the edge part of the sheet member around the opening formed in the sheet member, the positions of the first engaging units of the fan main body and the positions of the second engaging units of the ring member are matched, the ring member is fit around the outside of the cylinder unit of the fan main body from below the fan main body by utilizing the flexibility of the ring member and the first engaging units of the fan main body and the second engaging units of the ring member are engaged with each other and thereby, the ring member can be easily attach and firmly fixate to the fan main body. When the ring member and the fan main body are fixated in such way, the edge part of the sheet member around the opening formed in the sheet member is held between the back surface of the flange of the fan main body and one end surface of the ring member and thereby, as a result, the air circulator can be firmly attached to the sheet member. Further, to detach the air circulator from the sheet member, the ring member is held by the pair of pressing parts between a thumb and an index finger, for example, and the pair of pressing parts are squeezed so that the inner surfaces of the pressing parts come in contact with the outer surface of the cylinder unit of the fan main body by utilizing the flexibility of the ring member. Thereby, the areas near the pair of second parts bulge and the engaging state of the first engaging units and the second engaging unit will be released and thereby, the ring member can be easily detached from the fan main body. In such way, the air circulator of the present invention has a simple configuration and a user can easily attach and detach the air circulator to and from the sheet member. Therefore, the air circulator of the present invention can be used in air circulation-type mats, air conditioned outer wears and the like which function by circulating the air inside thereof, for example.

The invention claimed is:

1. An air circulator which is attached to a sheet member and which is for generating an air flow from one side of the sheet member to another side of the sheet member, comprising:

a fan main body; and a ring member for attaching the fan main body to the sheet member, wherein:

the fan main body comprises:

a hollow cylinder unit;

a flange which is formed on the hollow cylinder unit so as to protrude from an outer surface of the hollow cylinder unit in a direction approximately orthogonal to the outer surface of the hollow cylinder unit;

a motor fixing unit for fixating a motor;

a wing which is attached to a rotating shaft of the motor; and first engaging units which are formed on outer surfaces of first parts of the hollow cylinder unit, the first parts forming a pair and facing each other, the ring member comprises second engaging units which are formed on inner surfaces of second parts of the ring member, the second parts forming a pair and facing each other, and the second engaging units engaging with the first engaging units, a width between two points on an inner surface of the ring member at the second parts is equal to a width between two points on the outer surface of the hollow cylinder unit at the first parts or is smaller than the width between the two points on the outer surface of the hollow cylinder unit at the first parts, a width between two points on the inner surface of the ring member at a pair of pressing parts, the pressing parts being two parts which are shifted from the second parts by approximately 90 degrees, is larger than a width between two points on the outer surface of the hollow cylinder unit at two parts which are shifted from the first parts by approximately 90 degrees, an inner circumference of the ring member is larger than an outer circumference of the hollow cylinder unit, the ring member is flexible, the fan main body is attachable to the sheet member by fitting the ring member around the outer surface of the hollow cylinder unit utilizing the flexibility of the ring member so as to make an edge part of the sheet member around an opening formed in the sheet member be held between a back surface of the flange of the fan main body and one end surface of the ring member and to make the first engaging units and the second engaging units engage with each other, and the fan main body is detachable from the sheet member by squeezing the pair of pressing parts of the ring member so as to make the ring member bend, thereby releasing the engaging of the first engaging units and the second engaging units.

2. The air circulator of claim 1, wherein each of cross-sections of the hollow cylinder unit and the ring member when cut along a plane orthogonal to a center axis thereof is an approximately rectangular shape.

3. The air circulator of claim 1, wherein the second engaging units comprise protrusions which are formed on an outer surface of the ring member at the second parts.

4. The air circulator of claim 1, wherein a length of the inner circumference of the ring member is longer than a length of the outer circumference of the hollow cylinder unit by 1.0% to 3.5% of the length of the outer circumference of the hollow cylinder unit.

5. The air circulator of claim 1, wherein the first engaging units comprise concaves including engaging walls at lower surfaces thereof and the second engaging units comprise protrusions including engaging walls at lower surfaces thereof, or the first engaging units comprise protrusions including engaging walls at upper surfaces thereof which are formed on the outer surface of the hollow cylinder unit at the first parts and the second engaging units comprise concaves including engaging walls at upper surfaces thereof which are formed on the inner surface of the ring member at the second parts.

6. The air circulator of claim 1, wherein the first engaging units comprise protrusions including engaging walls at upper surfaces thereof, the protrusions being formed on the outer surface of the hollow cylinder unit at a lower end part at the first parts, and the second engaging units comprise cutouts formed at a lower end part of the ring member at the second parts.

7. The air circulator of claim 1, wherein a cross-section of the hollow cylinder unit when cut along a plane orthogonal to a center axis thereof is a circle shape and a cross-section of the ring member when cut along a plane orthogonal to a center axis thereof is an oval shape.

8. The air circulator of claim 1, wherein the first engaging units comprise protrusions which are formed on outer surfaces of parts of the hollow cylinder unit extending downward at the first parts and the second engaging units comprise cutouts formed at parts of a lower end surface of the ring member at the second parts.

9. An air circulator which is attached to a sheet member and which is for generating an air flow from one side of the sheet member to another side of the sheet member, comprising:

a fan main body; and a ring member for attaching the fan main body to the sheet member, wherein:

the fan main body comprises:

a hollow cylinder unit;

a flange which is formed on the hollow cylinder unit so as to protrude from an outer surface of the hollow cylinder unit in a direction approximately orthogonal to the outer surface of the hollow cylinder unit;

a motor fixing unit for fixating a motor;

a wing which is attached to a rotating shaft of the motor; and first engaging units which are formed on outer surfaces of first parts of the hollow cylinder unit, the first parts forming a pair and the first parts facing each other, the ring member comprises second engaging units which are formed on inner surfaces of second parts of the ring member, the second parts forming a pair and facing each other, and the second engaging units engaging with the first engaging units, a width between two points on an inner surface of the ring member at the second parts is equal to a width between two points on the outer surface of the hollow cylinder unit at the first parts or is smaller than the width between the two points on the outer surface of the hollow cylinder unit at the first parts, a width between two points on the inner surface of the ring member at a pair of pressing parts, the pressing parts being two parts which are shifted from the second parts by approximately 90 degrees, is larger than a width between two points on the outer surface of the hollow cylinder unit at two parts which are shifted from the first parts by approximately 90 degrees, an inner circumference of the ring member is larger than an outer circumference of the hollow cylinder unit, the ring member is flexible, outer edge parts of the ring member and a side that faces the flange of the fan main body at the pair of pressing parts are chamfered, the fan main body is attachable to the sheet member by fitting the ring member around the outer surface of the hollow cylinder unit utilizing the flexibility of the ring member so as to make an edge part of the sheet member around an opening formed in the sheet member be held between a back surface of the flange of the fan main body and one end surface of the ring member and to make the first engaging units and the second engaging units engage with each other, and the fan main body is detachable from the sheet member by squeezing the pair of pressing parts of the ring member so as to make the ring member bend, thereby releasing the engaging of the first engaging units and the second engaging units.

10. The air circulator of claim 9, wherein a cross-section of the hollow cylinder unit when cut along a plane orthogonal to a center axis thereof is a circle shape and a cross-section of the ring member when cut along a plane orthogonal to a center axis thereof is an oval shape.

11. The air circulator of claim 9, wherein each of cross-sections of the hollow cylinder unit and the ring member when cut along a plane orthogonal to a center axis thereof is an approximately rectangular shape.

12. The air circulator of claim 9, wherein the second engaging units comprise protrusions which are formed on an outer surface of the ring member at the second parts.

13. The air circulator of claim 9, wherein a length of the inner circumference of the ring member is longer than a length of the outer circumference of the hollow cylinder unit by 1.0% to 3.5% of the length of the outer circumference of the hollow cylinder unit.

14. The air circulator of claim 9, wherein the first engaging units comprise concaves including engaging walls at lower surfaces thereof and the second engaging units comprise protrusions including engaging walls at lower surfaces thereof, or the first engaging units comprise protrusions including engaging walls at upper surfaces thereof which are formed on the outer surface of the hollow cylinder unit at the first parts and the second engaging units comprise concaves including engaging walls at upper surfaces thereof which are formed on the inner surface of the ring member at the second parts.

15. The air circulator of claim 9, wherein the first engaging units comprise protrusions which are formed on outer surfaces of parts of the hollow cylinder unit extending downward at the first parts and the second engaging units comprise cutouts formed at parts of a lower end surface of the ring member at the second parts.

16. The air circulator of claim 9, wherein the first engaging units comprise protrusions including engaging walls at upper surfaces thereof, the protrusions being formed on the outer surface of the hollow cylinder unit at a lower end part at the first parts, and the second engaging units comprise cutouts formed at a lower end part of the ring member at the second parts.

* * * * *